US010220616B2

(12) United States Patent
Panchawagh et al.

(10) Patent No.: US 10,220,616 B2
(45) Date of Patent: Mar. 5, 2019

(54) METHODS, SYSTEMS, AND APPARATUSES FOR IMPROVING DROP VELOCITY UNIFORMITY, DROP MASS UNIFORMITY, AND DROP FORMATION

(71) Applicant: FUJIFILM DIMATIX, INC., Lebanon, NH (US)

(72) Inventors: Hrishikesh V. Panchawagh, San Jose, CA (US); Christoph Menzel, New London, NH (US)

(73) Assignee: FUJIFILM DIMATIX, INC., Lebanon, NH (US)

( * ) Notice: Subject to any disclaimer, the term of this patent is extended or adjusted under 35 U.S.C. 154(b) by 0 days.

(21) Appl. No.: 15/610,440

(22) Filed: May 31, 2017

(65) Prior Publication Data

US 2017/0259565 A1 Sep. 14, 2017

Related U.S. Application Data

(62) Division of application No. 14/152,728, filed on Jan. 10, 2014, now Pat. No. 9,669,627.

(51) Int. Cl.
*B41J 2/045* (2006.01)

(52) U.S. Cl.
CPC ..... *B41J 2/04598* (2013.01); *B41J 2/0456* (2013.01); *B41J 2/04525* (2013.01); *B41J 2/04561* (2013.01); *B41J 2/04581* (2013.01); *B41J 2/04588* (2013.01); *B41J 2/04593* (2013.01); *B41J 2/04595* (2013.01); *B41J 2/04596* (2013.01); *B41J 2202/12* (2013.01)

(58) Field of Classification Search
CPC ..... B41J 2/04596; B41J 2/04595
See application file for complete search history.

(56) References Cited

U.S. PATENT DOCUMENTS 5,138,333 A 8/1992 Bartky
8,465,129 B2 6/2013 Panchawagh et al.
(Continued)

FOREIGN PATENT DOCUMENTS

CN 1326403 A 12/2001
CN 101094769 A 12/2007
(Continued)

OTHER PUBLICATIONS

First Notification of Office Action for Chinese Patent Application No. 201480072660.9 dated Mar. 27, 2017, 2 pages.
(Continued)

*Primary Examiner* — Shelby L Fidler
(74) *Attorney, Agent, or Firm* — Womble Bond Dickinson (US) LLP

(57) ABSTRACT

Methods and systems are described herein for driving droplet ejection devices with multi-level waveforms. In one embodiment, a method for driving droplet ejection devices includes applying a multi-level waveform to the droplet ejection devices. The multi-level waveform includes a first section having at least one compensating edge and a second section having at least one drive pulse. The compensating edge has a compensating effect on systematic variation in droplet velocity or droplet mass across the droplet ejection devices. In another embodiment, the compensating edge has a compensating effect on cross-talk between the droplet ejection devices.

15 Claims, 18 Drawing Sheets

(56) References Cited

U.S. PATENT DOCUMENTS

| | | | | |
|---|---|---|---|---|
| 2002/0054197 | A1* | 5/2002 | Okada | B41J 2/01 347/101 |
| 2002/0109754 | A1* | 8/2002 | Fujii | B41J 2/04506 347/57 |
| 2003/0071869 | A1 | 4/2003 | Baba | |
| 2004/0023567 | A1 | 2/2004 | Koyama | |
| 2005/0200640 | A1 | 9/2005 | Hasenbein | |
| 2005/0259128 | A1 | 11/2005 | Kusunoki | |
| 2006/0092196 | A1 | 5/2006 | Iwao | |
| 2006/0092201 | A1 | 5/2006 | Gardner | |
| 2006/0181557 | A1 | 8/2006 | Hoisington et al. | |
| 2006/0284911 | A1* | 12/2006 | Norigoe | B41J 2/04541 347/11 |
| 2007/0030297 | A1 | 2/2007 | Norigoe | |
| 2008/0129771 | A1 | 6/2008 | Kim | |
| 2009/0244139 | A1 | 10/2009 | Takahashi | |
| 2009/0289982 | A1 | 11/2009 | Hasenbein | |
| 2009/0289983 | A1 | 11/2009 | Letendre, Jr. et al. | |
| 2011/0050769 | A1* | 3/2011 | Tsukamoto | B41J 2/04581 347/10 |
| 2012/0086755 | A1 | 4/2012 | Sayama | |
| 2013/0038651 | A1* | 2/2013 | Satou | B41J 29/02 347/9 |
| 2013/0249982 | A1 | 9/2013 | Marcus et al. | |
| 2014/0267481 | A1 | 9/2014 | Menzel | |
| 2015/0072458 | A1* | 3/2015 | Goto | H01L 51/56 438/46 |
| 2015/0118778 | A1 | 4/2015 | Takata | |
| 2015/0298455 | A1* | 10/2015 | Shimoda | B41J 2/04588 347/10 |

FOREIGN PATENT DOCUMENTS

| | | | |
|---|---|---|---|
| CN | 101970235 | A | 2/2011 |
| JP | 2000-218823 | A | 8/2000 |
| JP | 2003-326716 | A | 11/2003 |
| JP | 2004-090621 | A | 3/2004 |
| JP | 2004-249686 | A | 9/2004 |
| JP | 2007-022073 | A | 2/2007 |
| JP | 2009-234134 | A | 10/2009 |
| JP | 2011-520669 | | 7/2011 |
| JP | 2012-081624 | A | 4/2012 |
| WO | 2006052466 | A1 | 5/2006 |
| WO | 2013183280 | A1 | 12/2013 |

OTHER PUBLICATIONS

Supplementary European Search Report for EP14877991 dated Dec. 13, 2017.

PCT International Preliminary Report on Patentability for PCT/US2014/0065962 dated Jul. 12, 2016 dated Jul. 21, 2016.

PCT International Search Report and Written Opinion of the International Searching Authority for PCT/US14/65962, dated Jan. 22, 2015.

Office Action received for Japanese Patent Application No. 2016-545935, dated Aug. 16, 2018, 15 pages (7 pages of English Translation and 8 pages of Office Action).

European Search Report and Search Opinion Received for EP Application No. 14877991.1, dated Dec. 21, 2017, 8 pages.

* cited by examiner

METHODS, SYSTEMS, AND APPARATUSES FOR IMPROVING DROP VELOCITY UNIFORMITY, DROP MASS UNIFORMITY, AND DROP FORMATION

RELATED APPLICATIONS

This application is a divisional of U.S. application Ser. No. 14/152,728, filed on Jan. 10, 2014, the entire contents of which are hereby incorporated by reference.

TECHNICAL FIELD

Embodiments of the present invention relate to droplet ejection, and more specifically to applying compensating pulses via multi-level image mapping to improve drop velocity uniformity, drop mass uniformity, and drop formation.

BACKGROUND

Droplet ejection devices are used for a variety of purposes, most commonly for printing images on various media. Droplet ejection devices are often referred to as ink jets or ink jet printers. Drop-on-demand droplet ejection devices are used in many applications because of their flexibility and economy. Drop-on-demand devices eject one or more droplets in response to a specific signal, usually an electrical waveform that may include a single pulse or multiple pulses. Different portions of a multi-pulse waveform can be selectively activated to produce the droplets.

Droplet ejection devices typically include a fluid path from a fluid supply to a nozzle path. The nozzle path terminates in a nozzle opening from which droplets are ejected. Inkjet print heads exhibit highly coupled electrical, mechanical, and fluidic behavior and are sensitive to non-uniformities that arise from manufacturing variations, cross-talk, loading, and natural frequency response. Thus, non-uniformities in drop velocity and mass distribution exist across a print head having a large number of closely spaced nozzles. It is desirable to lower the impact of these non-uniformities on output pattern quality. Previous approaches include tightening manufacturing tolerances or additional electronics such as amplifiers and switches to drive various nozzles using separate waveforms to compensate for variations. However, these previous approaches are more expensive to implement because of the additional electronics and also require more time for separate waveforms.

SUMMARY

Methods and systems are described herein for driving droplet ejection devices with multi-level waveforms. In one embodiment, a method for driving droplet ejection devices includes generating a multi-level waveform having a compensating edge that is associated with at least one pulse in the multi-level waveform. The compensating edge is selected based on a spatial distribution of a droplet parameter and has a compensating effect to compensate for systematic variation across the droplet ejection devices. The method includes using the multi-level waveform in at least one of the droplet ejection devices to eject one or more droplets.

In another embodiment, a method for driving droplet ejection devices includes determining image data for the droplet ejection devices, converting the image data into converted data to be stored in an image buffer having first and second levels, processing the converted data to determine cross-talk affected data, and applying the multi-level waveform to the droplet ejection devices. The multi-level waveform includes a first section having at least one compensating edge and a second section having at least one drive pulse. The at least one compensating edge has a compensating effect to compensate for cross-talk variation across the droplet ejection devices.

BRIEF DESCRIPTION OF THE DRAWINGS

The present invention is illustrated by way of example, and not by way of limitation, in the figures of the accompanying drawings and in which.

DETAILED DESCRIPTION

Methods and systems are described herein for driving droplet ejection devices with multi-pulse waveforms. In one embodiment, a method for driving droplet ejection devices includes generating a multi-level waveform having a compensating edge that is associated with at least one pulse in the multi-level waveform. The compensating edge is selected based on a spatial distribution of a droplet parameter and has a compensating effect to compensate for systematic variation across the droplet ejection devices. The method includes using the multi-level waveform in at least one of the droplet ejection devices to eject one or more droplets.

Sources of drop velocity variation within an inkjet module include variation within a jet, jet to jet variation, and fluidic cross-talk. The within jet variation is dependent on a frequency response of the jet, image type, and print speed. The jet to jet variation can be caused by systematic variation due to manufacturing tolerances (e.g., piezoelectric properties or thickness variation). Fluidic cross-talk between jets depends on an image pattern.

Multi-level or multi-section waveforms can be designed with a velocity control compensating pulse to compensate for these variations in drop velocity. The velocity control compensating pulse can accelerate or decelerate drop velocity. Systematic variations such as jet to jet can be addressed using image pixel levels to apply compensation pulses as appropriate to selected jets. Frequency and cross-talk related variations can be addressed dynamically in a similar manner with image pixel levels. Various types of compensating pulses can be developed to correct drop mass variation as well.

The waveforms of the present application include a non-drop-firing portion to provide a compensating effect to compensate for drop velocity variation, drop mass variation, cross-talk, and drop formation variation between droplet ejection devices.

Figure 1:
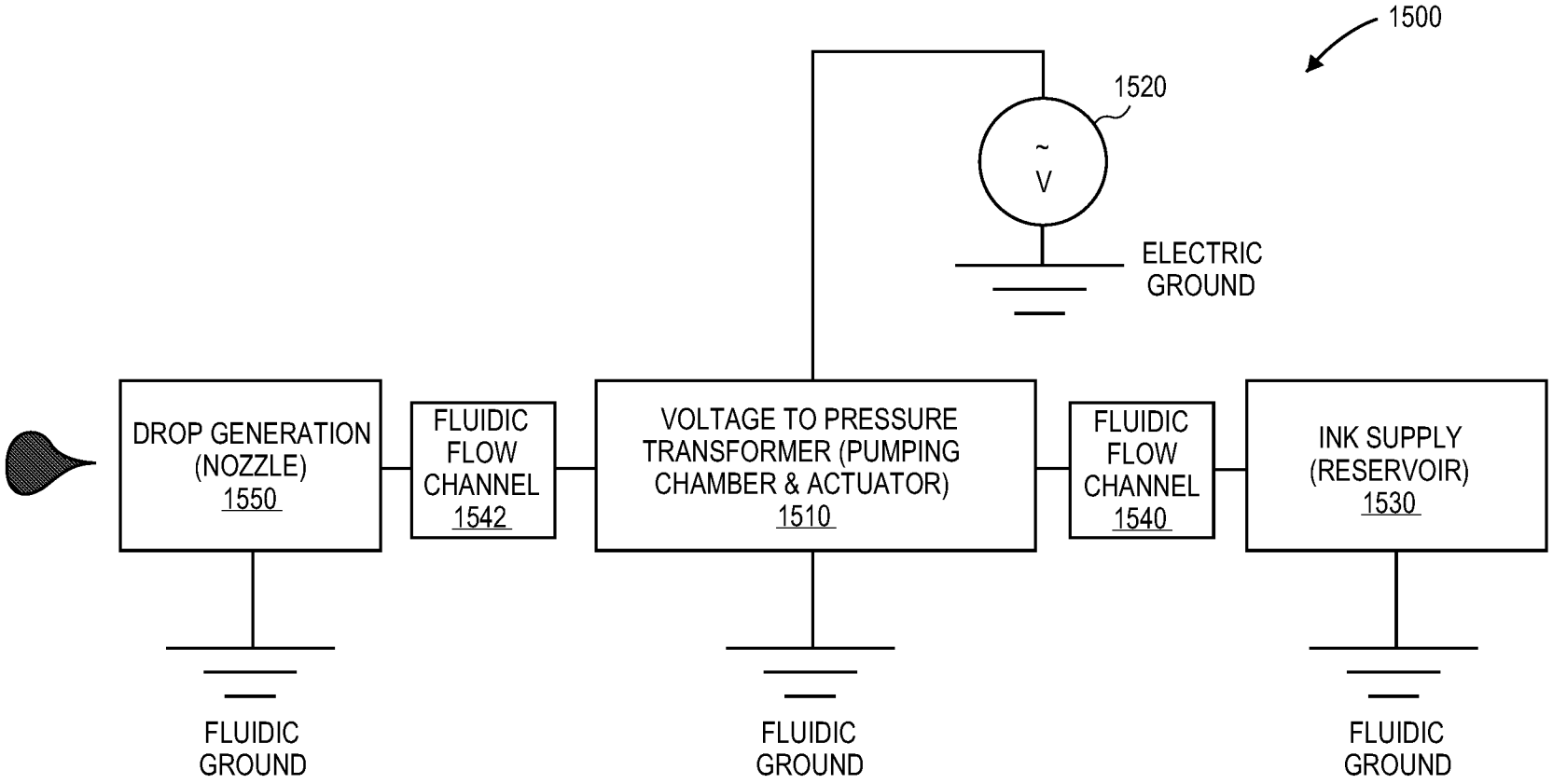
FIG. 1 illustrates a block diagram of an ink jet system in accordance with one embodiment.

FIG. 1 illustrates a block diagram of an ink jet system in accordance with one embodiment. The ink jet system 1500 includes a voltage source 1520 that applies a voltage to pressure transformer 1510 (e.g., pumping chamber and actuator), which may be a piezoelectric or heat transformer. An ink supply 1530 supplies ink to a fluidic flow channel 1540, which supplies ink to the transformer. The transformer provides the ink to a fluidic flow channel 1542. This fluidic flow channel allows pressure from the transformer to propagate to a drop generation device 1550 having orifices or nozzles and generate one or more droplets if one or more pressure pulses are sufficiently large. Ink level in the ink jet system 1500 is maintained through a fluidic connection to the ink supply 1530. The drop generation device 1550, transformer 1540, and ink supply 1530 are coupled to fluidic ground while the voltage supply is coupled to electric ground.

Figure 2:
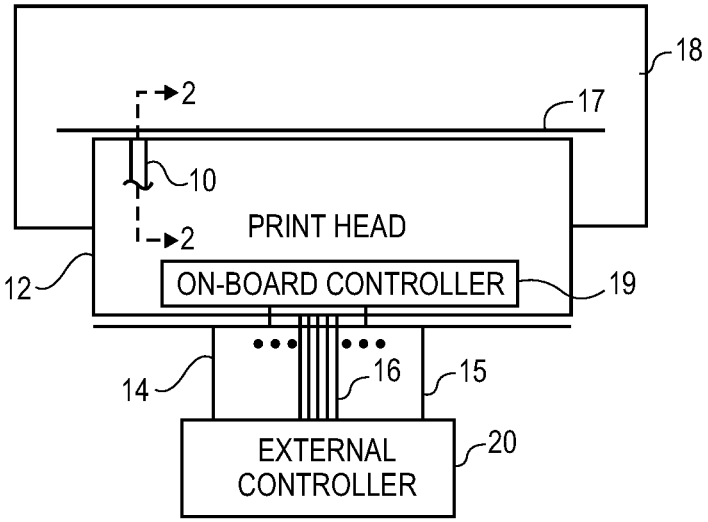
FIG. 2 is a piezoelectric ink jet print head in accordance with one embodiment.

FIG. 2 is a piezoelectric ink jet print head in accordance with one embodiment. As shown in FIG. 2, the 128 individual droplet ejection devices 10 (only one is shown on FIG. 2) of print head 12 are driven by constant voltages provided over supply lines 14 and 15 and distributed by on-board control circuitry (on-board controller) 19 to control firing of the individual droplet ejection devices 10. External controller 20 supplies the voltages over lines 14 and 15 and provides control data, logic power, and timing over additional lines 16 to on-board control circuitry 19. Ink jetted by the individual ejection devices 10 can be delivered to form print lines 17 on a substrate 18 that moves under print head 12. While the substrate 18 is shown moving past a stationary print head 12 in a single pass mode, alternatively the print head 12 could also move across the substrate 18 in a scanning mode.

In one embodiment, a print head (e.g., print head 12) includes an ink jet module that includes droplet ejection devices to eject droplets of a fluid and control circuitry (e.g., on-board controller 19) that is coupled to the droplet ejection devices. During operation, the control circuitry drives the droplet ejection devices by applying a multi-level waveform to the droplet ejection devices. The multi-level waveform includes a first section having at least one compensating edge and a second section having at least one drive pulse. The compensating edge has a compensating effect to compensate for systematic variation in a droplet parameter (e.g., droplet velocity, droplet mass) across the droplet ejection devices of the print head.

At least one of the control circuitry and a controller (e.g., external controller 20, a processing system, etc.) execute instructions or perform operations to determine a spatial distribution of a droplet ejection parameter across the droplet ejection devices and determine a mapping for mapping image pixel levels of the multi-level waveform based on the spatial distribution of the droplet ejection parameter. Alternatively, a different processing system provides the spatial distribution of the droplet ejection parameter and determines a mapping for mapping image pixel levels of the multi-level waveform based on the spatial distribution of the droplet ejection parameter. The spatial distribution of the droplet ejection parameter can include a spatial distribution of a droplet velocity across the droplet ejection devices. The spatial distribution of the droplet ejection parameter can include a spatial distribution of a droplet mass across the droplet ejection devices. At least one of the control circuitry and controller execute instructions or perform operations to identify first and second groups of the droplet ejection devices within the spatial distribution and to convert pixels in the second group into a second level of the multi-level waveform while pixels in the first group remain in a first level of the multi-level waveform. The compensating edge or pulse may cause an increase or a decrease in drop mass of droplets ejected by the droplet ejection devices. The compensating edge or pulse can reduce a frequency response variation of droplets ejected by the droplet ejection devices.

In another embodiment, a print head includes an ink jet module that includes droplet ejection devices to eject droplets of a fluid and control circuitry coupled to the droplet ejection devices. During operation, the control circuitry drives the droplet ejection devices by applying a multi-level waveform to the droplet ejection devices. The multi-level waveform includes a first section having a compensating pulse with a compensating effect to compensate for cross-talk across the droplet ejection devices and a second section having at least one drive pulse. At least one of the control circuitry and the controller determine image data for the droplet ejection devices, convert the image data into converted data to be stored in an image buffer having first and second levels, and process the converted data to determine cross-talk affected data. Processing the buffer data for cross-talk includes identifying pixels that are affected by cross-talk. At least one of the control circuitry and the controller execute instructions to shift the identified pixels that are affected by cross-talk into a third level of the image buffer. The at least one compensating edge or pulse increases or decreases a drop velocity of the droplets ejected by the droplet ejection devices.

Figure 3:
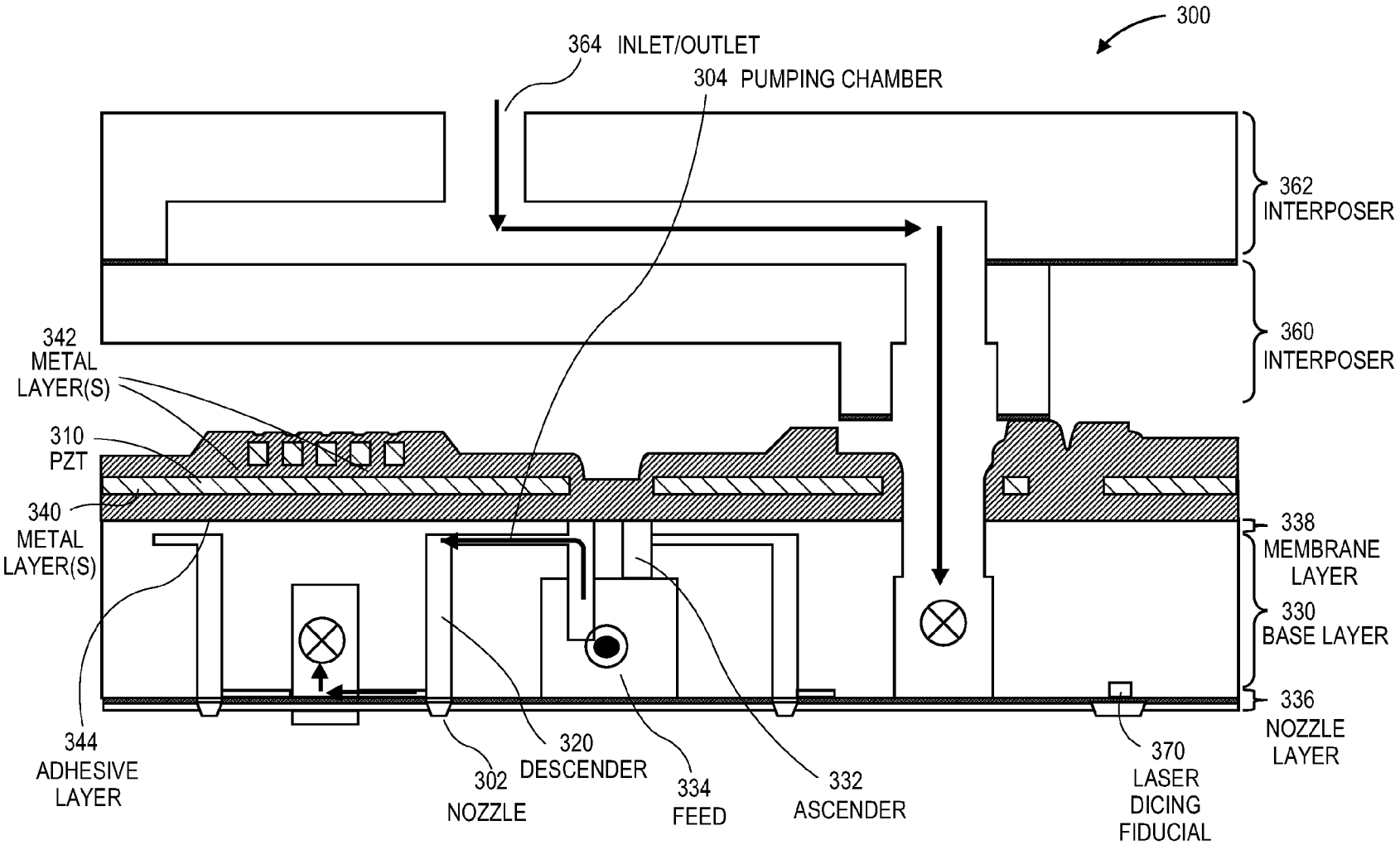
FIG. 3 illustrates a piezoelectric drop on demand print head module for ejecting droplets of ink on a substrate to render an image in accordance with one embodiment.

FIG. 3 illustrates a cross-section view of a piezoelectric drop on demand print head module for ejecting droplets of ink on a substrate to render an image in accordance with one embodiment. The module 300 has a series of closely spaced nozzle openings from which ink can be ejected. Each nozzle opening 302 is served by a flow path including a pumping chamber 304 where ink is pressurized by a piezoelectric actuator 310. Other modules may be used with the techniques described herein.

A piezoelectric (PZT) actuator 310 sits on top of the ink pumping chamber. When pressured by the piezoelectric actuator, ink flows from the ink chamber through the descender 320 and out of the KOH nozzle opening 302 (as indicated by the arrows). Furthermore, a base silicon layer 330 of the module body in the print head defines an ascender 332, a feed 334, and the pumping chamber 304 as shown in FIG. 3. Ink flows from the feed into the pumping chamber as indicated by the arrows.

A nozzle portion is formed of a silicon layer 336. In one embodiment, the nozzle silicon layer 336 is fusion bonded to the base silicon layer and defines. A membrane silicon layer 338 may be fusion bonded to the base silicon layer, opposite to the nozzle silicon layer.

One or more metal layers 340 and 342 on or below the PZT layer 310 are used to form a ground electrode and a drive electrode. The metallized PZT layer is bonded to the silicon membrane by an adhesive layer 344. In one embodiment, the adhesive is polymerized benzocyclobutene (BCB) but may be various other types of adhesives as well. Interposers 360 and 362 provide an inlet/outlet 364 into an opening of the membrane layer and the base layer. The base layer and nozzle layer provide a laser dicing fidicial 370. Multiple jetting structures can be formed in a single print head die. In one embodiment, during manufacture, multiple dies are formed contemporaneously.

A PZT member or element (e.g., actuator) is configured to vary the pressure of fluid in the pumping chambers in response to the drive pulses applied from the drive electronics (e.g., control circuitry). For one embodiment, the actuator ejects droplets of a fluid from a nozzle via the pumping chambers. The drive electronics are coupled to the PZT member.

Figure 4:
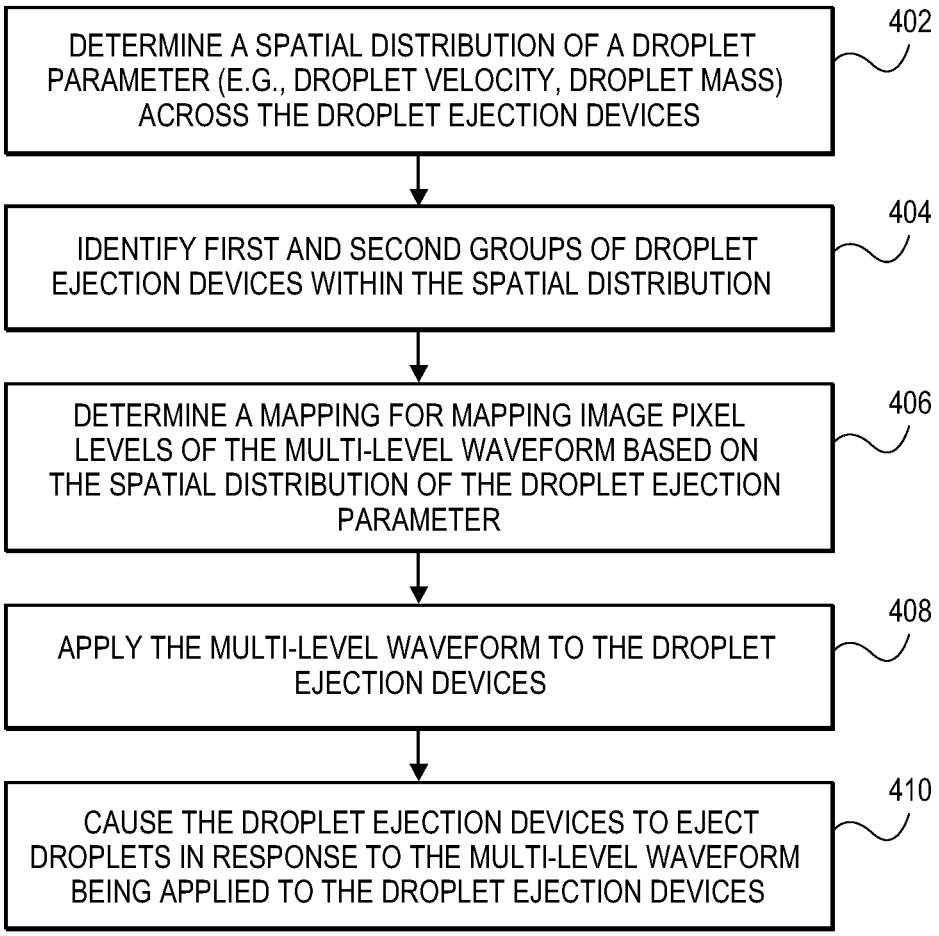
FIG. 4 illustrates a flow diagram of a process for driving droplet ejection devices within a print head or ink jet system with a multi-level waveform to compensate for systematic variation of at least one droplet parameter across the droplet ejection devices in accordance with one embodiment.

FIG. 4 illustrates a flow diagram of a process for driving droplet ejection devices within a print head or ink jet system with a multi-level waveform to compensate for systematic variation of at least one droplet parameter across the droplet ejection devices in accordance with one embodiment. The operations of the process may be performed with control circuitry, a controller, a processing system, or some combination of these components. In one embodiment, the process for driving the droplet ejection devices includes determining a spatial distribution of a droplet parameter (e.g., droplet velocity, droplet mass) across the droplet ejection devices of a print head or ink jet system at block 402. The process identifies first and second groups of droplet ejection devices within the spatial distribution at block 404. For example, for the droplet velocity parameter, the first group may include droplet ejection devices that eject droplets with a faster droplet velocity and the second group may include droplet ejection devices that eject droplets with a slower droplet velocity. For the droplet mass parameter, the first group may include nozzles that eject droplets with a heavier droplet mass and the second group may include nozzles that eject droplets with a lighter droplet mass. The process may include determining a mapping for mapping image pixel levels of the multi-level waveform based on the spatial distribution of the droplet ejection parameter at block 406. Determining the mapping may include converting pixels in the second group into a second level of the multi-level waveform. The pixels in the first group can remain by default with a first level of the multi-level waveform or can be mapped into the first level. The process applies the multi-level waveform to the droplet ejection devices at block 408. The multi-level waveform includes a first section having at least one compensating edge or at least one compensating pulse with a compensating effect to compensate for systematic variation of the droplet parameter across the droplet ejection devices and a second section having at least one drive pulse. The process causes the droplet ejection devices to eject droplets at block 410 in response to the multi-level waveform being applied to one or more of the droplet ejection devices at block 408.

In one embodiment, a pressure response wave that is caused by the at least one compensating edge, which may be a compensating pulse or multiple compensating pulses, is in resonance (i.e., in phase) or approximately in resonance with respect to pressure wave(s) of the at least one drive pulse. Alternatively, a pressure response wave that is caused by at least one compensating edge, which may be a compensating pulse or multiple compensating pulses, is approximately in anti-resonance (i.e., out of phase) with respect to the pressure response waves of the at least one drive pulse. A peak voltage of the compensating edge or compensating pulse may be less than a peak voltage of the at least one drive pulse. A pulse width of the compensating pulse may be similar to a pulse width of the at least one drive pulse.

A compensating edge or a compensating pulse is designed to not eject a droplet. The compensating edge or the compensating pulse also has a lower maximum voltage amplitude in comparison to drive pulses to avoid ejecting a droplet.

In one embodiment, each droplet ejection device ejects additional droplets of the fluid in response to the pulses of the multi-level waveform or in response to pulses of additional multi-level waveforms. A waveform may include a series of sections that are concatenated together. Each section may include a certain number of samples that include a fixed time period (e.g., 1 to 3 microseconds) and associated amount of data. The time period of a sample is long enough for control logic of the drive electronics to enable or disable each jet nozzle for the next waveform section. In one embodiment, the waveform data is stored in a table as a series of address, voltage, and flag bit samples and can be accessed with software. A waveform provides the data necessary to produce a single sized droplet and various different sized droplets. For example, a waveform can operate at a frequency of 20 kiloHertz (kHz) and produce three different sized droplets by selectively activating different pulses of the waveform. These droplets are ejected at approximately the same target velocity.

Figure 5:
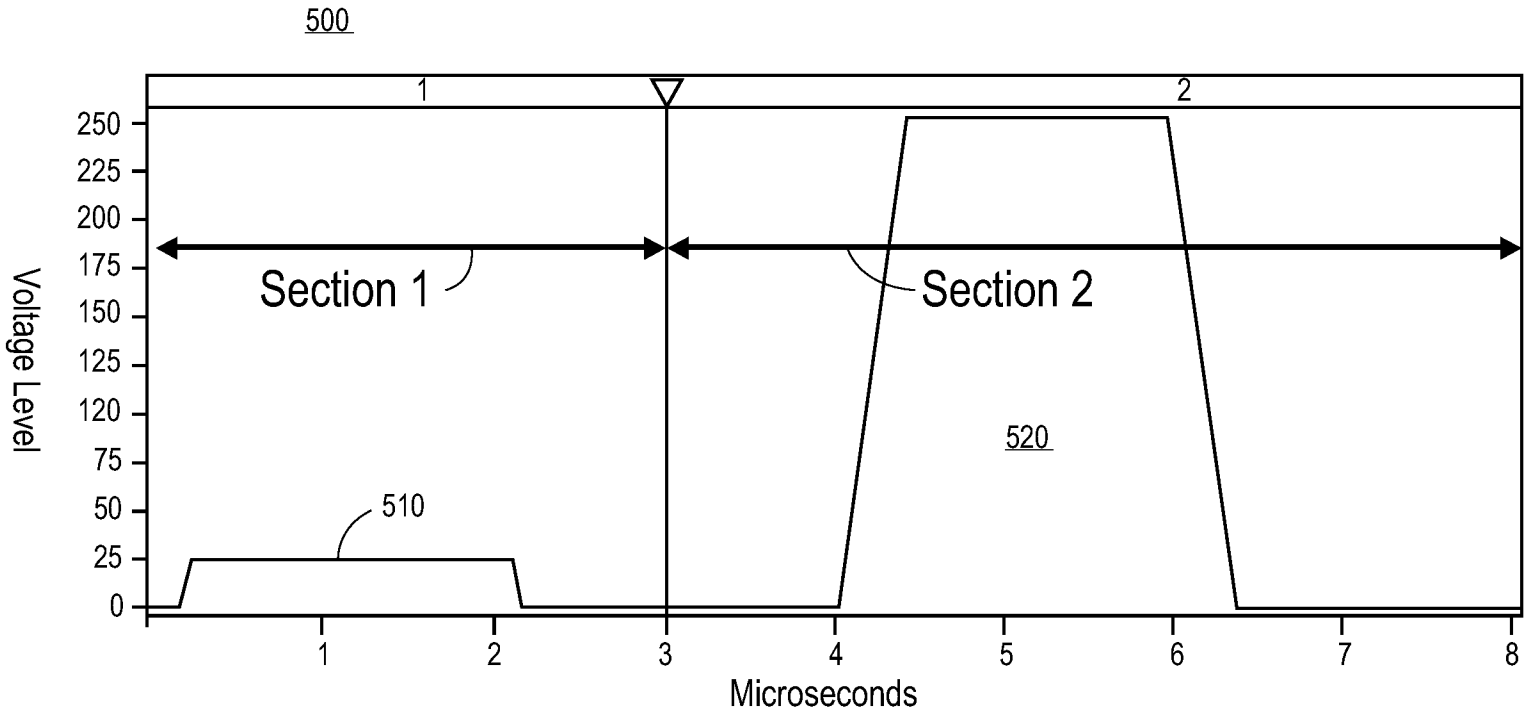
FIG. 5 shows a multi-level waveform 500 in accordance with one embodiment.

FIG. 5 shows a multi-level waveform 500 in accordance with one embodiment. Section 1 of the waveform includes a compensating pulse 510 and section 2 includes a drive pulse 520. Section 1 corresponds to a time period of approximately three microseconds of the waveform and section 2 corresponds to approximately the remaining five microseconds of the waveform. The compensating pulse 510 has a compensating effect to compensate for systematic variation across the droplet ejection devices of a print head. The time period from a firing of the compensating pulse to a subsequent firing of a drive pulse may be approximately a resonance time period.

Table 1 shows a sectional mapping for the waveform 500.

TABLE 1

| Section Mapping | | | |
|---|---|---|---|
| Section No. | 1 | 2 | Other non-drop forming waveform (NOT SHOWN) |
| No Print (Level 0) | OFF | OFF | ON |
| Level 1 | OFF | ON | Optional |
| Level 2 | ON | ON | Optional |

Figure 6:
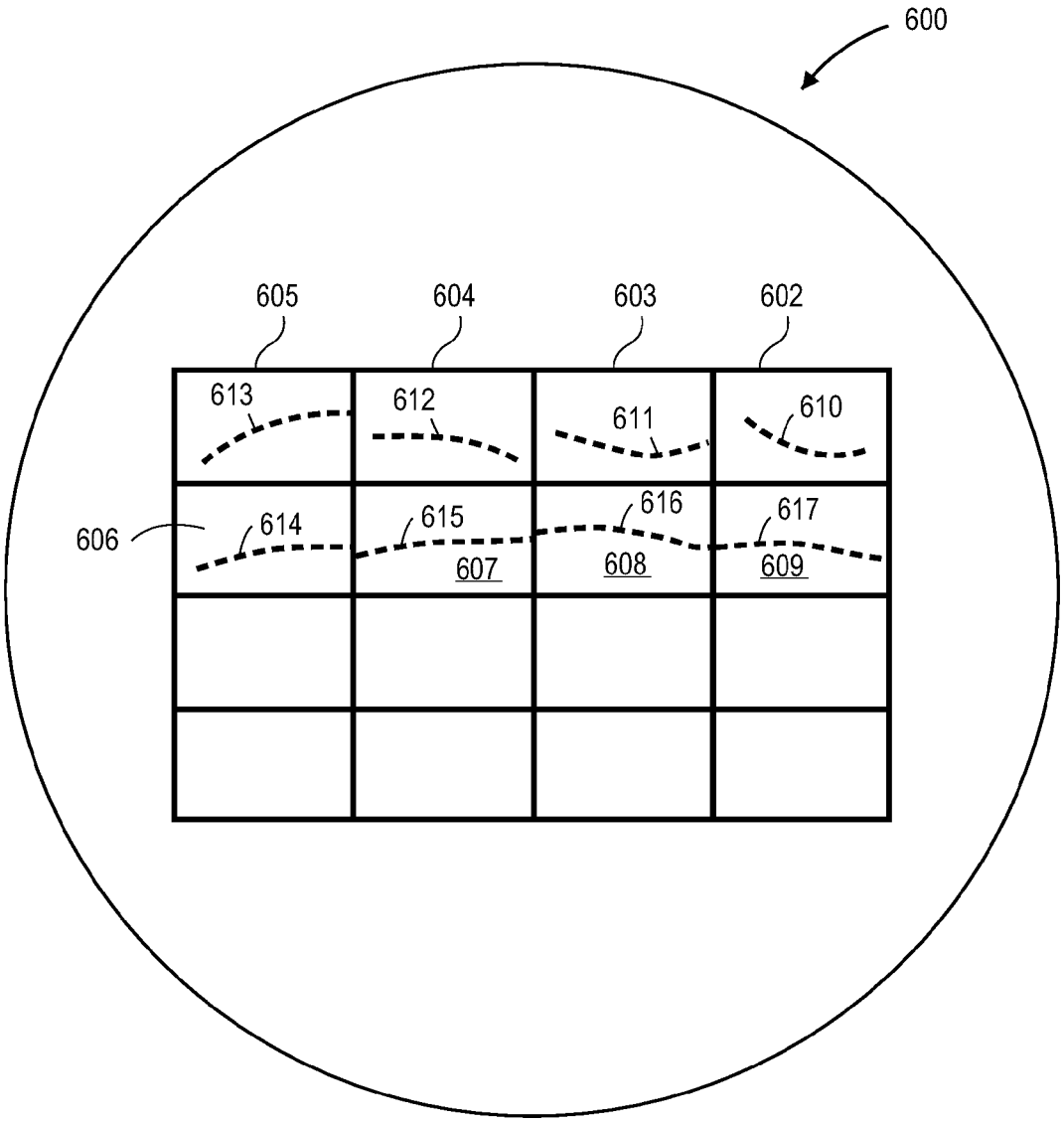
FIG. 6 illustrates a wafer with multiple dies and corresponding spatial distributions of drop velocity in accordance with one embodiment.

FIG. 6 illustrates a wafer with multiple dies and corresponding spatial distributions of drop velocity in accordance with one embodiment. The dies 602-608 include a respective spatial distribution of drop velocity 610-617. The spatial distribution of drop velocity has a systematic signature that is dependent on die location on the wafer 600. The compensating pulse discussed herein is designed to compensate for systematic drop velocity variation across different die locations. In one embodiment, each die location corresponds to a different print head. For example, the die 602 includes a distribution of drop velocity 610 that decreased from left to right across the die in general. The droplet ejection devices that correspond to slower drop velocities of the distribution of drop velocity 610 can be compensated with a compensating pulse to accelerate the drop velocity for these droplet ejection devices and reduce the systematic drop velocity variation.

Figure 7:
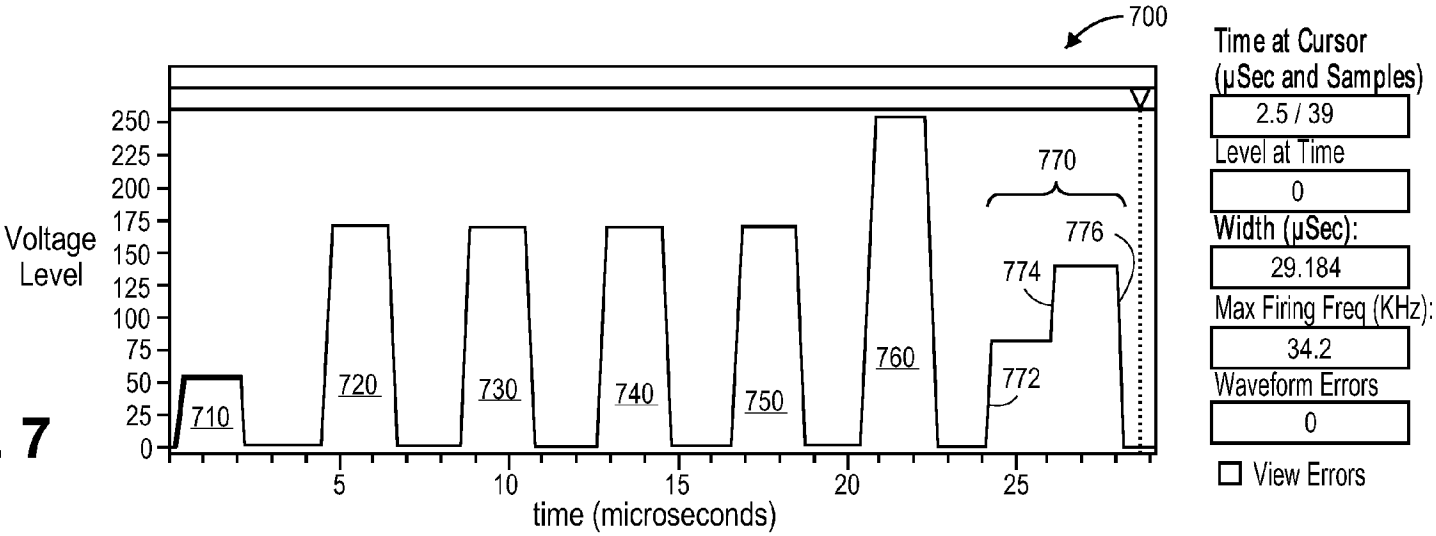
FIG. 7 shows a multi-level waveform 700 with a compensating pulse in accordance with one embodiment.

FIGS. 7-12 illustrates different types of multi-level waveforms for correcting systematic drop velocity or drop mass variations across droplet ejection devices. FIG. 7 shows a multi-level waveform 700 with a compensating pulse in accordance with one embodiment. The waveform includes a compensating pulse 710 (e.g., located in section 1), drive pulses 720-760 (e.g., located in section 2), and a non-drop-firing portion 770 includes a jet straightening edge 772 having a droplet straightening function and cancellation edges 774 and 776 having an energy canceling function. The drive pulses cause the droplet ejection device to eject a droplet of a fluid. The compensating pulse 710 has a compensating effect to compensate for systematic variation across the droplet ejection devices. The compensating pulse by itself does not fire a droplet. The compensating pulse 710 adds energy to the droplet ejection device to increase the drop velocity and drop mass of one or more of the subsequent driving pulses. The time period from firing the compensating pulse to a subsequent firing of a drive pulse may be approximately in resonance with a resonance time period of the drive pulses.

Figure 8:
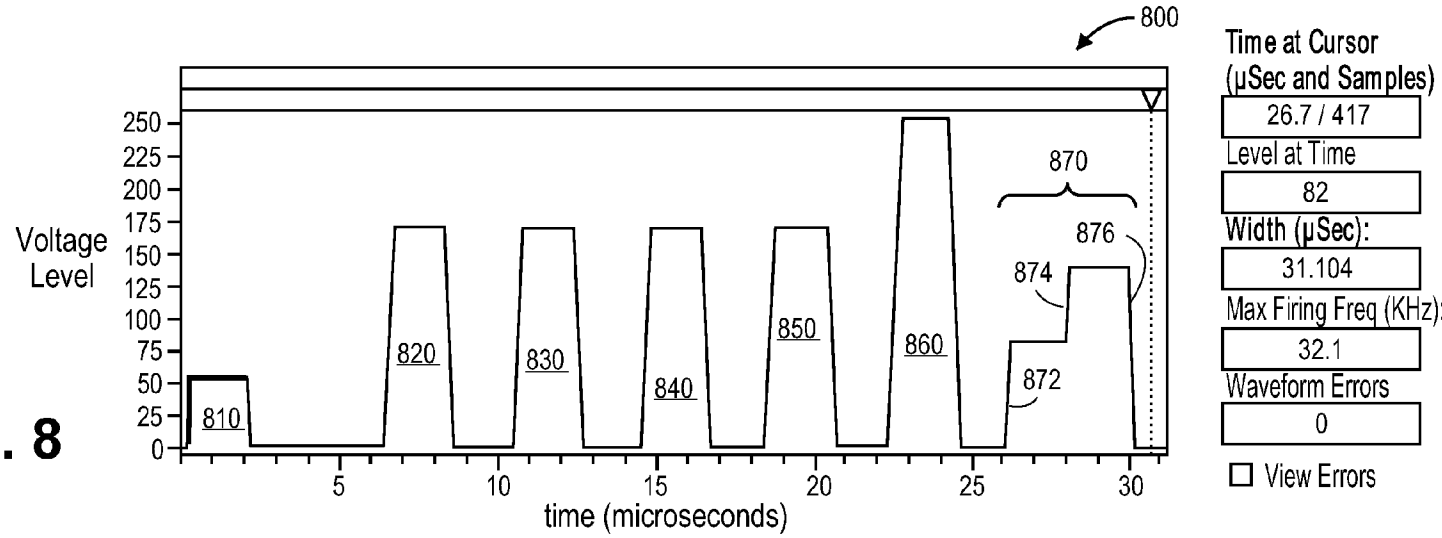
FIG. 8 shows a multi-level waveform 800 with a compensating pulse in accordance with one embodiment.

FIG. 8 shows a multi-level waveform 800 with a compensating pulse in accordance with one embodiment. The waveform includes a compensating pulse 810 (e.g., located in section 1), drive pulses 820-860 (e.g., located in section 2), and a non-drop-firing portion 870 includes a jet straightening edge 872 having a droplet straightening function and cancellation edges 874 and 876 having an energy canceling function. The compensating pulse 810 has a compensating effect to compensate for systematic variation across the droplet ejection devices of a print head. The compensating pulse 810 reduces energy to the droplet ejection device to decrease the drop velocity and drop mass of one or more of the subsequent driving pulses. The time period from firing the compensating pulse to a subsequent firing of a drive pulse (e.g., leading edge of compensating pulse to leading edge of drive pulse, falling edge of compensating pulse to falling edge of drive pulse) may be approximately out of phase (anti-resonance) in comparison to a resonance time period of the drive pulses.

Figure 9:
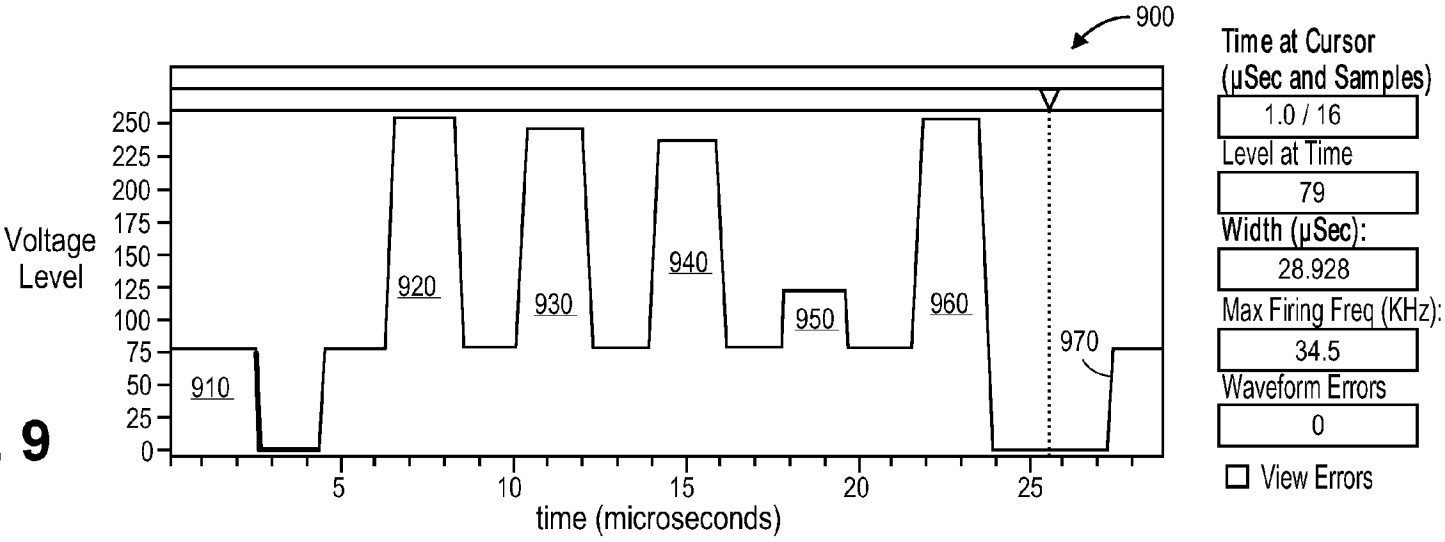
FIG. 9 shows a multi-level waveform 900 with a compensating pulse in accordance with one embodiment.

FIG. 9 shows a multi-level waveform 900 with a compensating pulse in accordance with one embodiment. The waveform includes a compensating pulse 910 (e.g., located in section 1), drive pulses 920-960 (e.g., located in section 2), and a cancellation edge 970 having an energy canceling function. The drive pulses cause the droplet ejection device to eject a droplet of a fluid. The compensating pulse 910 has a compensating effect to compensate for systematic variation across the droplet ejection devices. The compensating pulse by itself does not fire a droplet. The compensating pulse 910 adds energy to the droplet ejection device to increase the drop velocity and drop mass of one or more of the subsequent driving pulses. The time period from firing the compensating pulse to a subsequent firing of a drive pulse may be approximately in anti-resonance with a resonance time period of the drive pulses.

Figure 10:
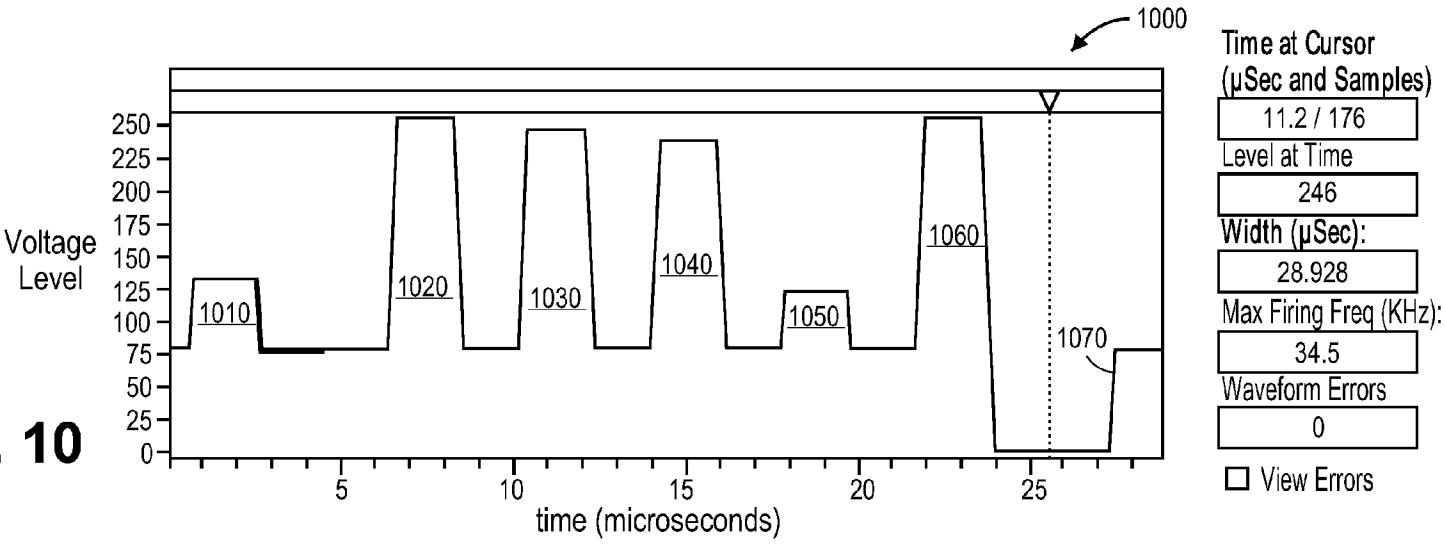
FIG. 10 shows a multi-level waveform 1000 with a compensating pulse in accordance with one embodiment.

FIG. 10 shows a multi-level waveform 1000 with a compensating pulse in accordance with one embodiment. The waveform includes a compensating pulse 1010 (e.g., located in section 1), drive pulses 1020-1060 (e.g., located in section 2), and a cancellation edge 870 having an energy canceling function. The compensating pulse 1010 has a compensating effect to compensate for systematic variation across the droplet ejection devices. The compensating pulse 1010 reduces energy to the droplet ejection device to decrease the drop velocity and drop mass of one or more of the subsequent driving pulses. The time period from firing the compensating pulse to a subsequent firing of a drive pulse (e.g., leading edge of compensating pulse to leading edge of drive pulse, falling edge of compensating pulse to falling edge of drive pulse) may be approximately out of phase (anti-resonance) in comparison to a resonance time period of the drive pulses.

Figure 11:
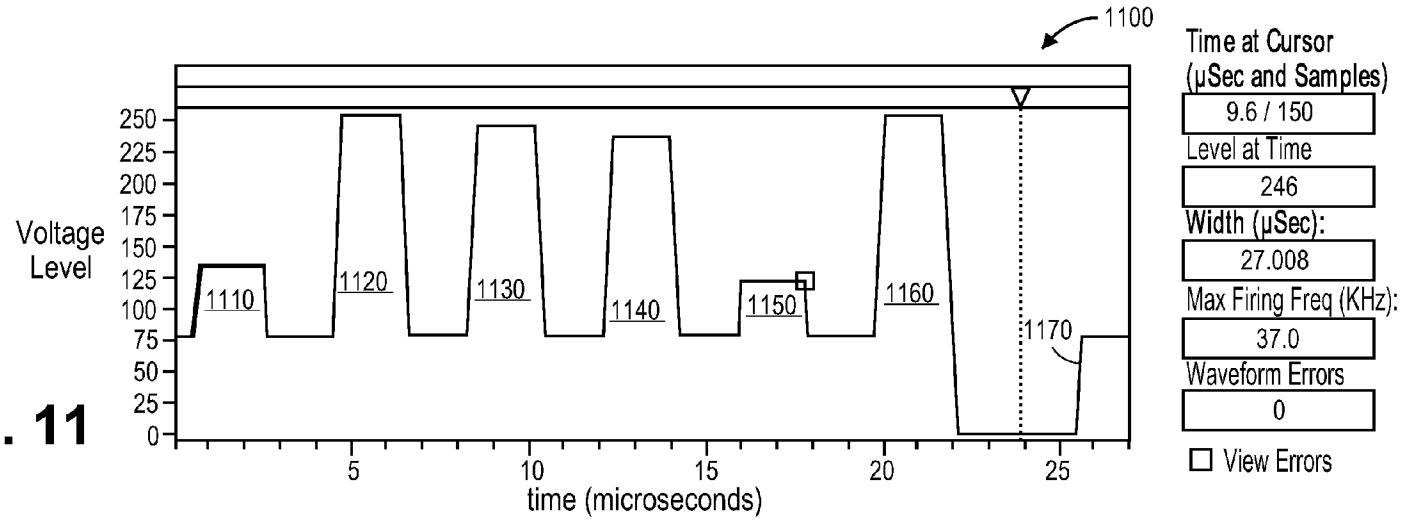
FIG. 11 shows a multi-level waveform 1100 with a compensating pulse in accordance with one embodiment.

FIG. 11 shows a multi-level waveform 1100 with a compensating pulse in accordance with one embodiment. The waveform includes a compensating pulse 1110 (e.g., located in section 1), drive pulses 1120-1160 (e.g., located in section 2), and a cancellation edge 1170 having an energy canceling function. The drive pulses cause the droplet ejection device to eject a droplet of a fluid. The compensating pulse 1110 has a compensating effect to compensate for systematic variation across the droplet ejection devices of a print head. The compensating pulse by itself does not fire a droplet. The compensating pulse 1110 adds energy to the droplet ejection device to increase the drop velocity and drop mass of one or more of the subsequent driving pulses. The time period from firing the compensating pulse to a subsequent firing of a drive pulse may be approximately in resonance with a resonance time period of the drive pulses.

Figure 12:
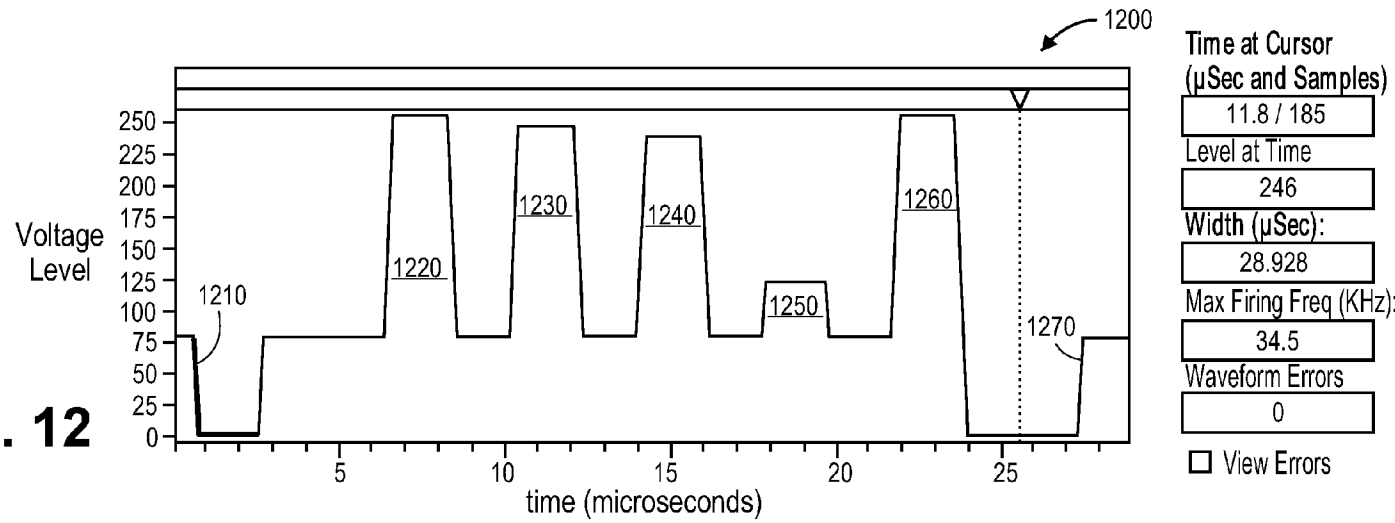
FIG. 12 shows a multi-level waveform 1200 with a compensating pulse in accordance with one embodiment.

FIG. 12 shows a multi-level waveform 1200 with a compensating pulse in accordance with one embodiment. The waveform includes a compensating edge 1210 (e.g., located in section 1), drive pulses 1220-1260 (e.g., located in section 2), and a cancellation edge 1270 having an energy canceling function. The compensating edge 1210 has a compensating effect to compensate for systematic variation across the droplet ejection devices. The compensating edge 1210 adds energy to the droplet ejection device to increase the drop velocity and drop mass of one or more of the subsequent driving pulses. The time period from firing the compensating edge to a subsequent firing of a similar edge of a drive pulse (e.g., falling edge of compensating pulse to falling edge of drive pulse) may be approximately in resonance in comparison to a resonance time period of the drive pulses.

A same sense cancellation pulse (or cancellation edge(s)) as illustrated in FIGS. 7 and 8 is preceded by a cancel edge delay, which has a voltage level that is similar to a voltage level of one or more delays between drive pulses. An opposite sense cancellation pulse (or cancellation edge(s)) as illustrated in FIGS. 9-12 is preceded by a cancel edge delay, which has a voltage level that is different than a voltage level of one or more delays between drive pulses. The voltage level of the cancel edge delay is in the opposite direction, relative to the bias level or level between fire pulses, compared to the fire pulse.

Figure 13:
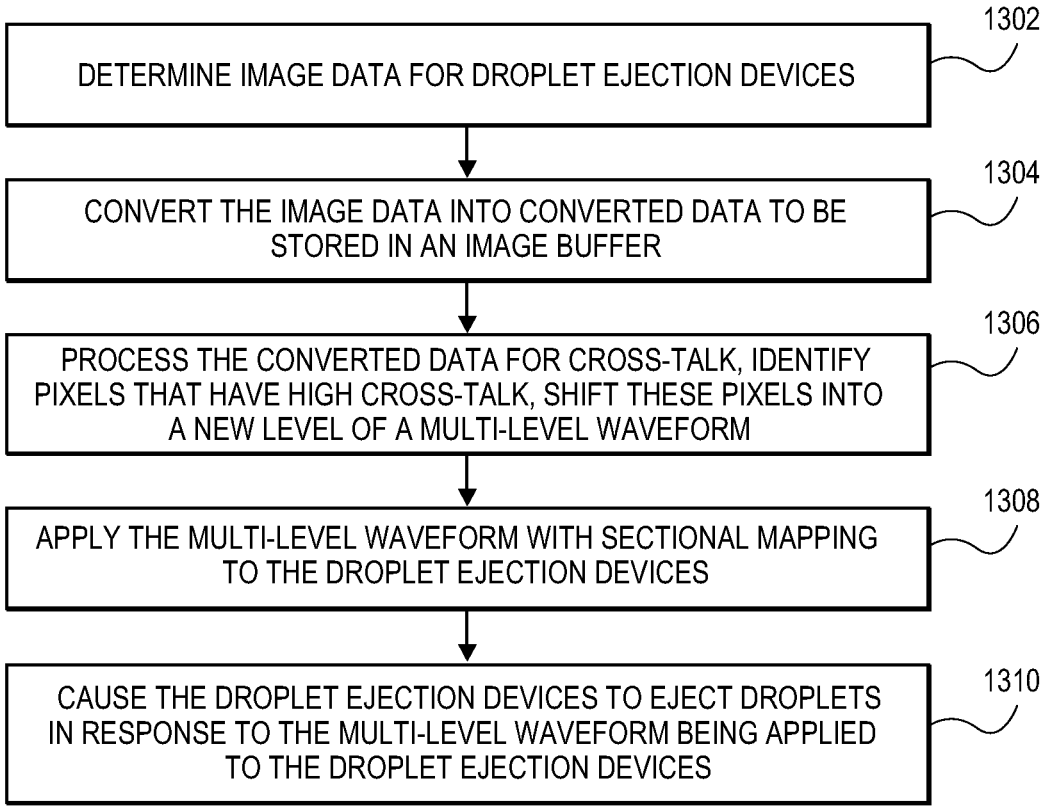
FIG. 13 illustrates a flow diagram of a process for driving droplet ejection devices within a print head or ink jet system with a multi-level waveform to compensate for cross-talk between droplet ejection devices in accordance with one embodiment.

FIG. 13 illustrates a flow diagram of a process for driving droplet ejection devices within a print head or ink jet system with a multi-level waveform to compensate for cross-talk between droplet ejection devices of a print head or ink jet system in accordance with one embodiment. The multi-level waveforms may have 4 levels for a bit depth of 2, 8 levels for a bit depth of 3, etc. In one embodiment, the process for driving the droplet ejection devices includes determining image data at block 1302. The process converts the image data into converted data to be stored in an image buffer at block 1304. For example, the image buffer will contain level 0 and level 1 with level 1 being for printed pixels of the image data. The process may include processing the converted data for cross-talk at block 1306. Processing the converted data may include identifying pixels that have high cross-talk and shifting them into a new level 2. For example, converted data that forms a low density image may have low cross-talk while converted data that forms a high density image may have high cross-talk. The image data can be printed and the drop velocity can be measured for the printed pattern. The data from the printed pattern that corresponds to slower drop velocity can be shifted into level 2. The process applies the multi-level waveform with sectional mapping to the droplet ejection devices at block 1308. The multi-level waveform includes a first section having at least one compensating edge or at least one compensating pulse with a compensating effect to compensate for cross-talk between the droplet ejection devices and a second section having at least one drive pulse. The process causes the droplet ejection devices to eject droplets at block 1310 in response to the multi-level waveform being applied to the droplet ejection devices at block 1308.

In one embodiment, a pressure response wave of the at least one compensating edge or at least one compensating pulse is in resonance (i.e., in phase) or approximately in resonance with respect to pressure wave(s) of the at least one drive pulse. In another embodiment, a pressure response wave of at least one compensating edge or at least one cancellation pulse is approximately in anti-resonance (i.e., out of phase) with respect to the pressure response waves of the at least one drive pulse. A peak voltage of the compensating pulse may be less than a peak voltage of the at least one drive pulse. A peak voltage of the cancellation pulse may be less than a peak voltage of the at least one drive pulse.

Figure 14:
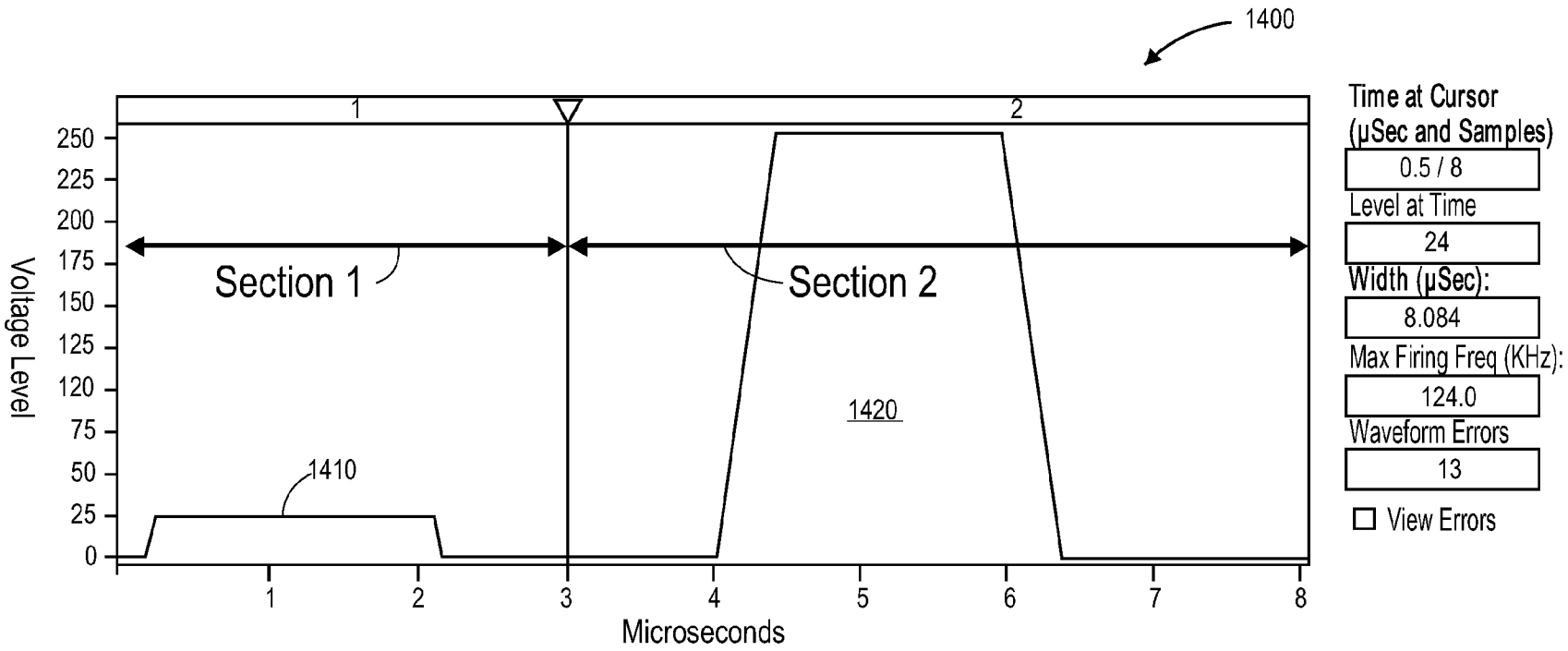
FIG. 14 shows a multi-level waveform 1400 in accordance with one embodiment.

FIG. 14 shows a multi-level waveform 1400 in accordance with one embodiment. Section 1 of the waveform includes a compensating pulse 1410 and section 2 includes a drive pulse 1420. Section 1 corresponds to a time period of approximately three microseconds of the waveform and section 2 corresponds to approximately the remaining five microseconds of the waveform. The compensating pulse 1410 has a compensating effect to compensate for cross-talk between the droplet ejection devices. The time period from one firing the compensating pulse to a subsequent firing of drive pulse may be approximately a resonance time period.

Table 2 shows a sectional mapping for the waveform 1400.

TABLE 2

| Section Mapping | | | |
|---|---|---|---|
| Section No. | 1 | 2 | Other non-drop forming waveform (NOT SHOWN) |
| No Print (Level 0) | OFF | OFF | ON |
| Level 1 | OFF | ON | Optional |
| Level 2 | ON | ON | Optional |

Figure 15A:
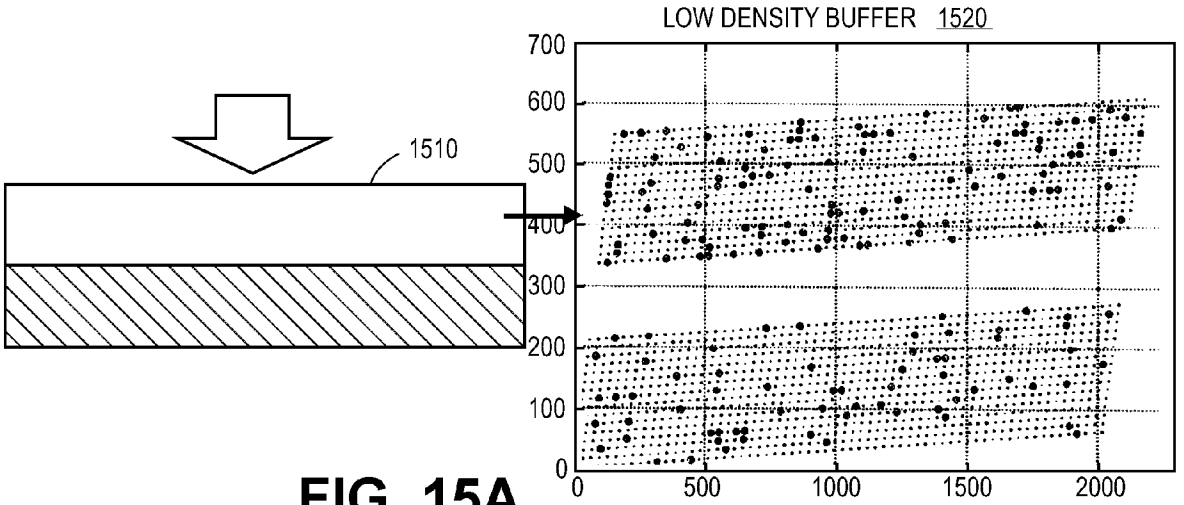
FIG. 15*a* illustrates converting image data into a low density buffer in accordance with one embodiment.

FIG. 15*a* illustrates converting image data into a low density buffer in accordance with one embodiment. The image data 1510 is converted into converted buffer data and then stored as a low density buffer 1520. For a sparse pattern as illustrated in FIG. 15*a* no correction or compensation is needed.

Figure 15B:
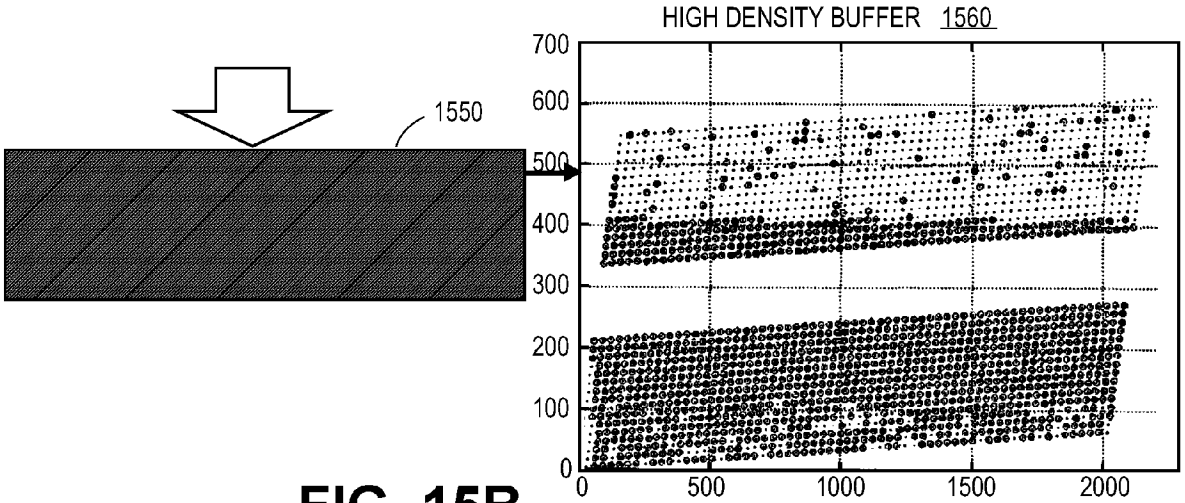
FIG. 15*b* illustrates converting image data into a high density buffer in accordance with one embodiment.

FIG. 15*b* illustrates converting image data into a high density buffer in accordance with one embodiment. The image data 1550 is converted into converted buffer data and then stored as a high density buffer 1560. For a dense pattern as illustrated in FIG. 15*b* real time analysis or pre-processing is needed to determine a number of droplet ejection devices fired for a given buffer. If the nozzles in a certain nozzle pattern are adjacent to each other, then cross-talk will likely occur and modify the drop velocity (e.g., slow the drop velocity). In such patterns, pixels are shifted to level 2 and printed with a compensating pulse to compensate for the cross-talk. Note that the compensating pulse can add energy and increase drop velocity. Increasing an amplitude of a compensating pulse increases drop velocity until a desired or optimal drop velocity is obtained. Alternatively, the compensating pulse can reduce energy in the waveform and decrease drop velocity. Decreasing an amplitude of a compensating pulse decreases drop velocity until a desired or optimal drop velocity is obtained.

The at least one compensating edge or compensating pulse can correct for drop mass and velocity non-uniformities as well as drop formation non-uniformities. Drop formation affects print head sustainability. Prior approaches that use image preprocessing increase voltages, which causes more drop satellites or sub-drops, and damages a print head over time.

Figure 16A:
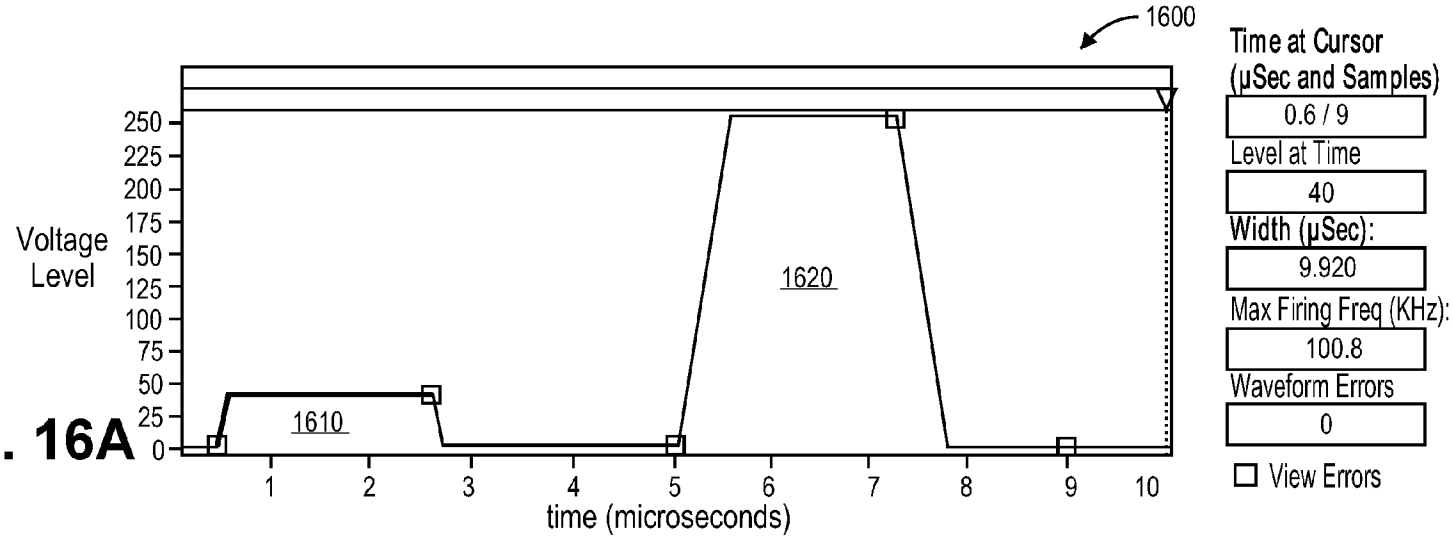
FIG. 16*a* illustrates a 1 bit waveform with a compensating pulse in accordance with one embodiment.
Figure 16B:
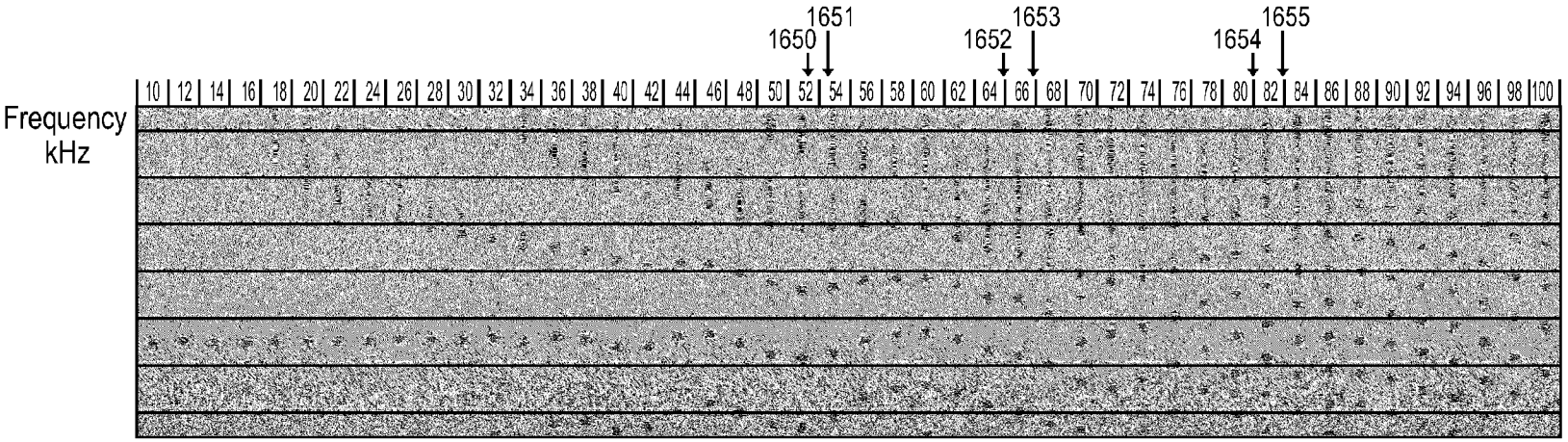
FIG. 16*b* illustrate a frequency response graph with drop formation issues at certain frequencies.

FIG. 16*a* illustrates a 1 bit waveform with a compensating pulse in accordance with one embodiment. The 1 bit waveform 1600 includes a prepulse or compensating pulse 1610 and a drive pulse 1620. The compensating pulse 1610 adds energy to the waveform. This waveform may be susceptible to drop formation issues at certain frequencies as illustrated in FIG. 16*b* in one embodiment. The arrows 1650-1655 indicate drop formation issues for certain frequencies in kHz.

Figure 17A:
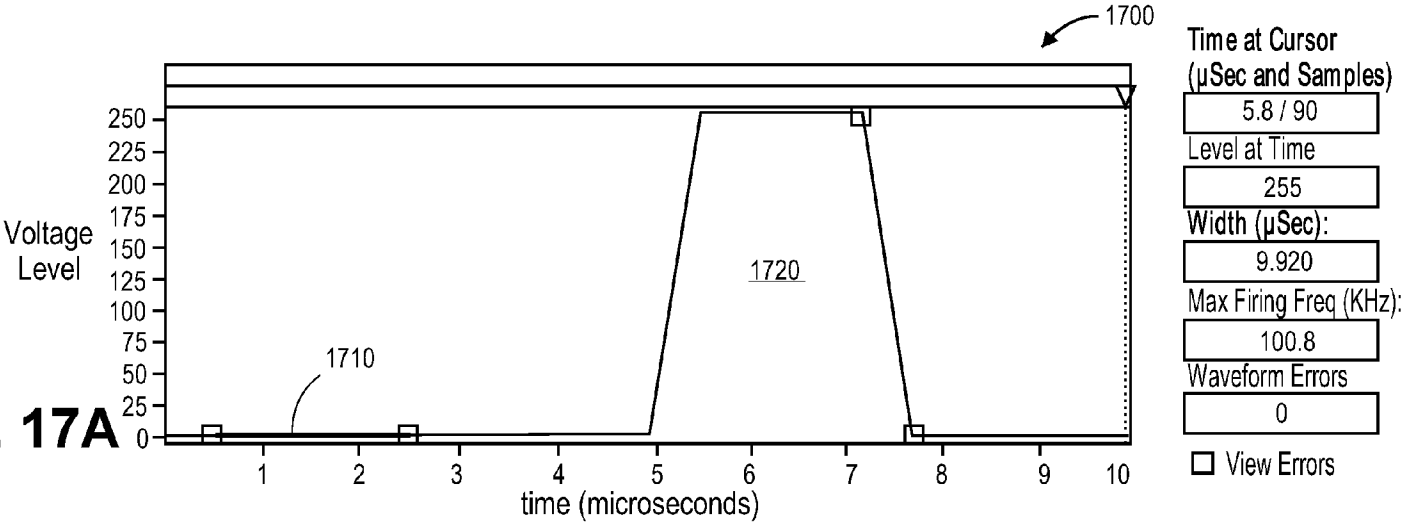
FIG. 17*a* illustrates a 1 bit waveform with a compensating pulse in accordance with one embodiment.
Figure 17B:
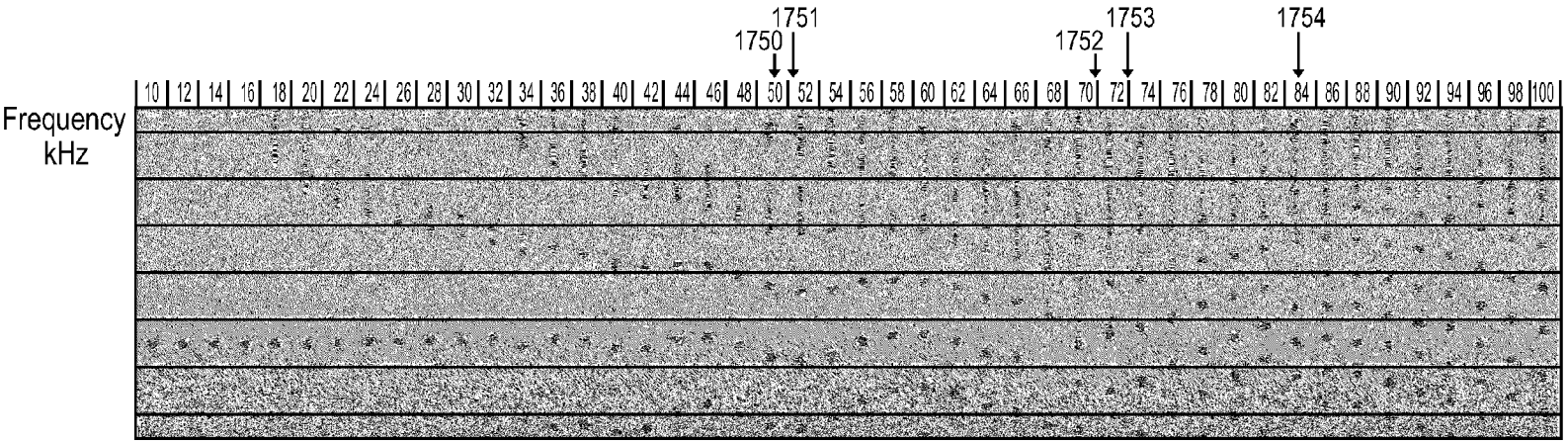
FIG. 17*b* illustrate a frequency response graph with drop formation issues at certain frequencies.

FIG. 17*a* illustrates a 1 bit waveform with a compensating pulse in accordance with one embodiment. The 1 bit waveform 1700 includes a prepulse or compensating pulse 1710 and a drive pulse 1720. The compensating pulse 1710 does not add energy to the waveform. This waveform may be susceptible to drop formation issues at certain frequencies as illustrated in FIG. 17*b* in one embodiment. The arrows 1750-1754 indicate drop formation issues for certain frequencies in kHz.

Figure 18A:
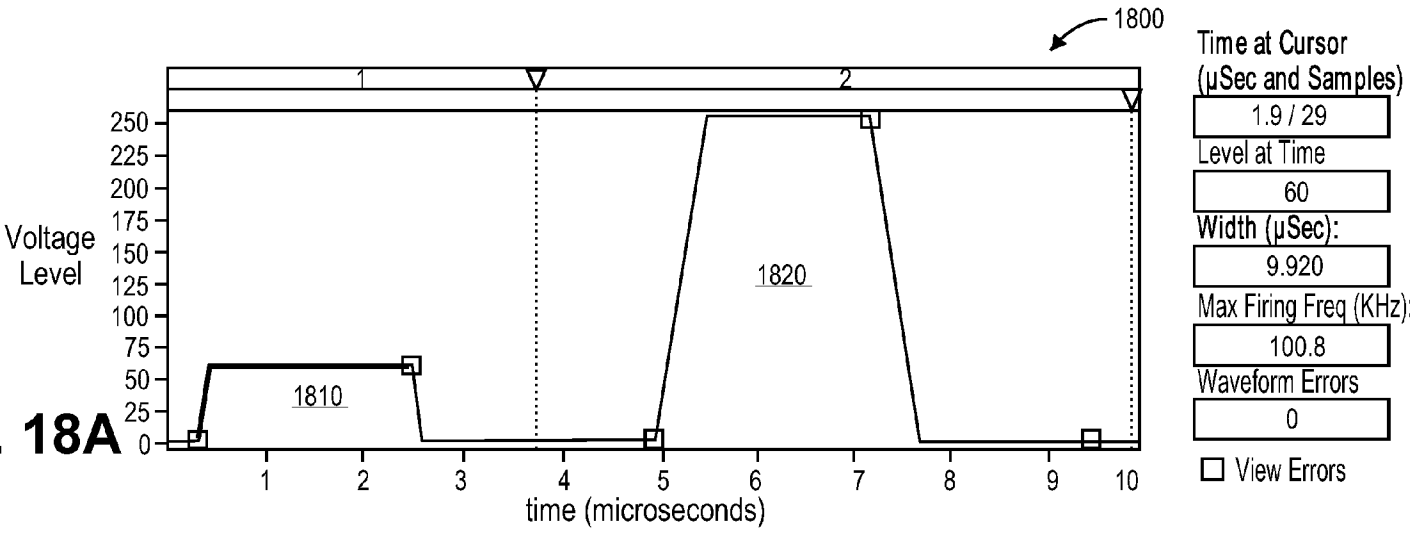
FIG. 18*a* illustrates a 2 bit waveform with a compensating pulse in accordance with one embodiment.
Figure 18B:
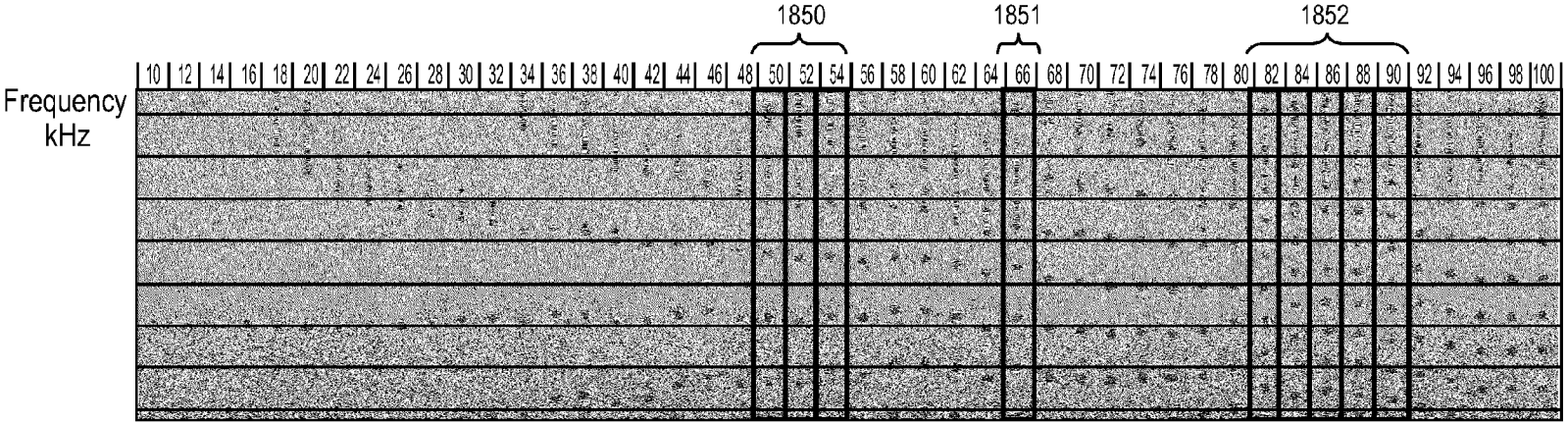
FIG. 18*b* illustrate a frequency response graph with drop formation issues at certain frequencies.

FIG. 18*a* illustrates a 2 bit waveform with a compensating pulse in accordance with one embodiment. The 2 bit waveform 1800 includes a prepulse or compensating pulse 1810 and a drive pulse 1820. The compensating pulse 1810 adds energy to the waveform. This waveform reduces drop formation issues as illustrated in FIG. 18*b* in one embodiment. The compensating pulse is associated with a first section while the drive pulse is associated with a second section. The first section is mapped to level 2 while the second section is mapped to level 1 or 2. Drop formation is improved by applying the prepulse to level 2 and applying level 1 with the drive pulse by itself to the frequency ranges 1850-1852 as indicated in FIG. 18B.

A more uniform frequency response can be obtained using different combinations of waveform sections depending on jetting frequency. Thus, a frequency dependent variation in drop velocity and drop volume can be reduced.

Figure 19A:
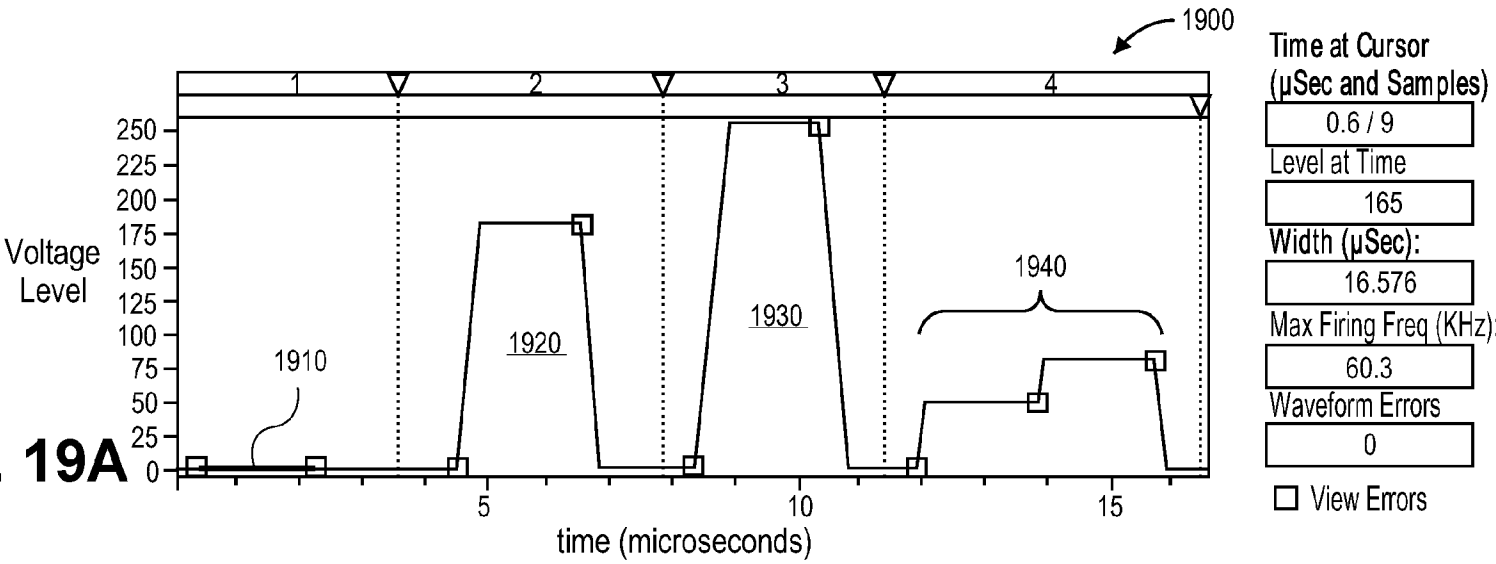
FIG. 19*a* illustrates a 2 bit waveform with a compensating pulse in accordance with one embodiment.
Figure 19B:
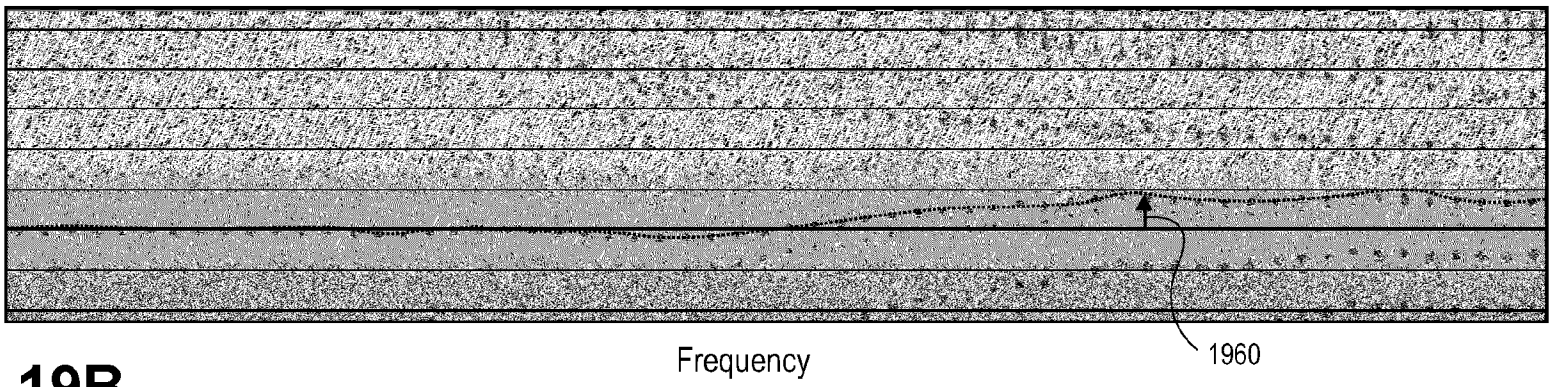
FIG. 19*b* illustrates a frequency response graph with frequency response variation in one embodiment.

FIG. 19*a* illustrates a 2 bit waveform with a compensating pulse in accordance with one embodiment. The 2 bit waveform 1900 includes a prepulse or compensating pulse 1910, drive pulses 1920 and 1930, and a non-drop-forming portion 1940. This waveform has a frequency response variation as illustrated in FIG. 19*b* in one embodiment. The compensating pulse is associated with a first section, the drive pulse 1920 is associated with a second section, and the drive pulse 1930 is associated with a third section. The frequency response graph 1950 illustrates a 2 pulse drop created by sections 2 and 3. The arrow 1960 illustrates a frequency response variation induced by an increase in frequency from left to right of the graph 1950.

Figure 20A:
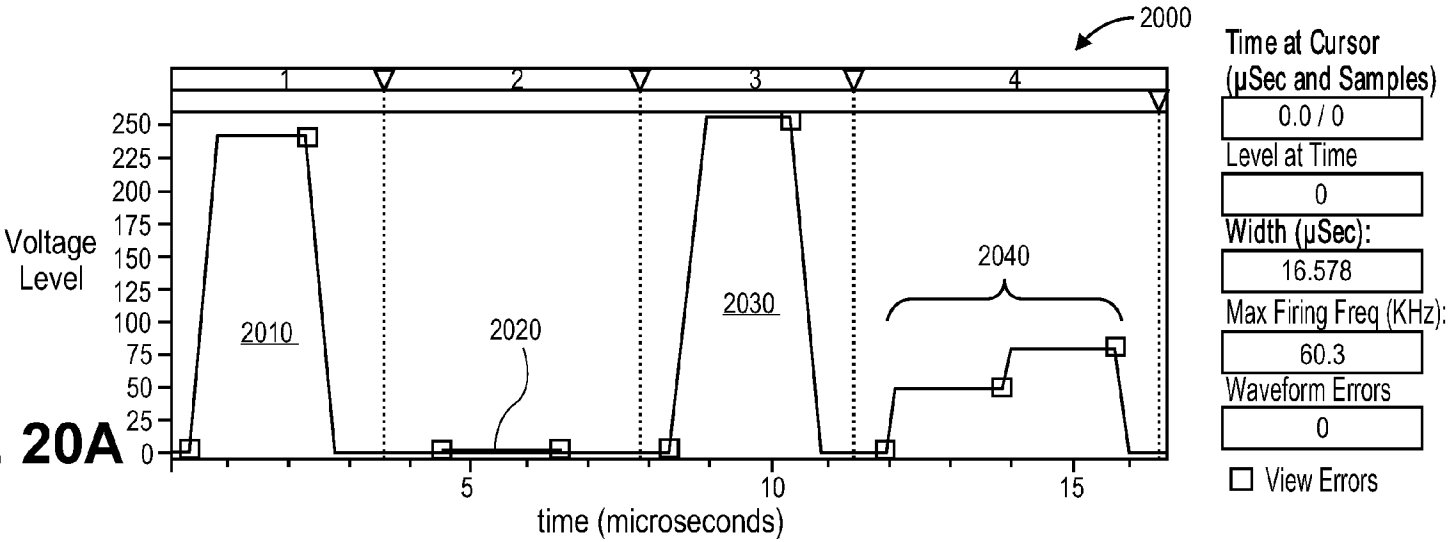
FIG. 20*a* illustrates a 2 bit waveform with a compensating pulse in accordance with one embodiment.
Figure 20B:
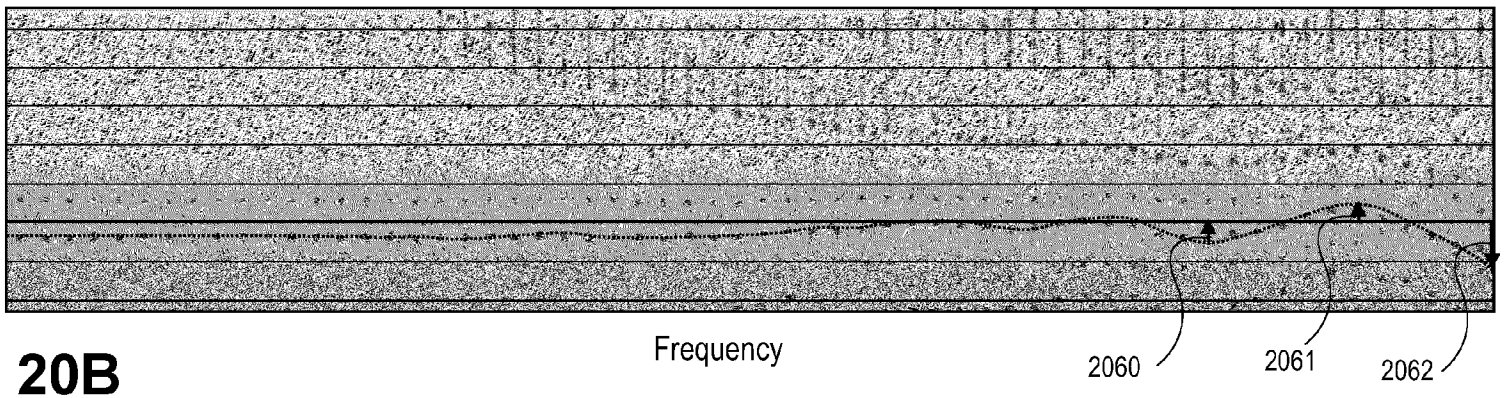
FIG. 20*b* illustrates a frequency response graph with frequency response variation in one embodiment.

FIG. 20*a* illustrates a 2 bit waveform with a compensating pulse in accordance with one embodiment. The 2 bit waveform 2000 includes a prepulse or compensating pulse 2020, drive pulses 2010 and 2030, and a non-drop-forming portion 2040. This waveform has a frequency response variation as illustrated in FIG. 20*b* in one embodiment. The compensating pulse is associated with a second section, the drive pulse 2010 is associated with a first section, and the drive pulse 2030 is associated with a third section. The frequency response graph 2050 illustrates a 2 pulse drop created by sections 1 and 3. The arrows 2060-2062 illustrate a frequency response variation induced by an increase in frequency from left to right of the graph 2050.

Figure 21A:
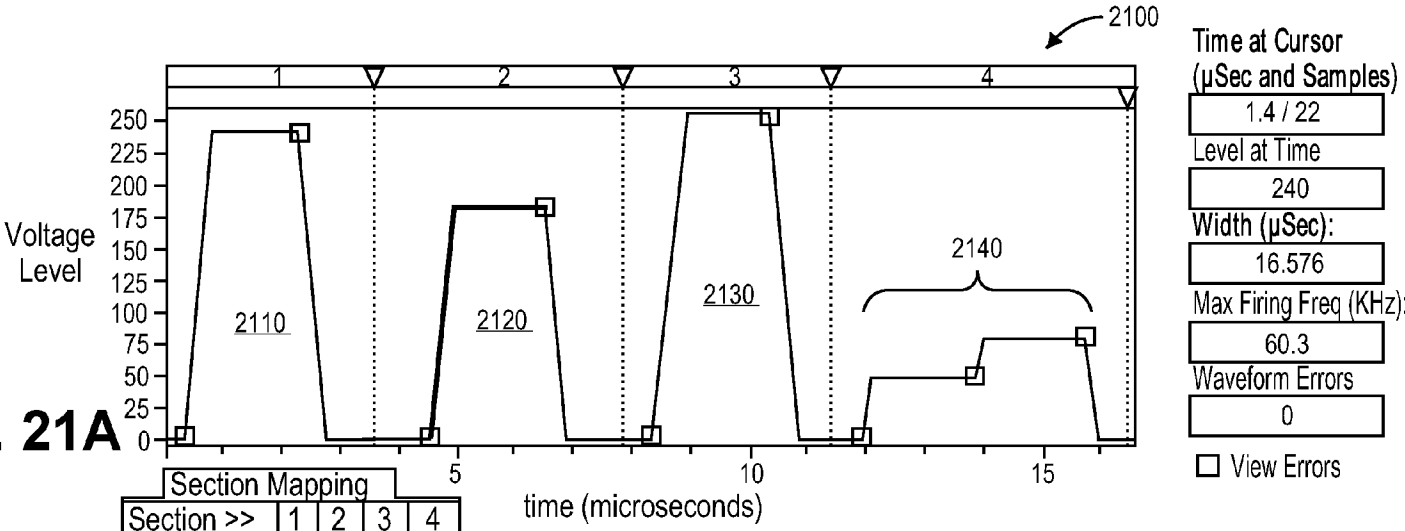
FIG. 21*a* illustrates a 2 bit waveform with a compensating pulse in accordance with one embodiment.
Figure 21B:
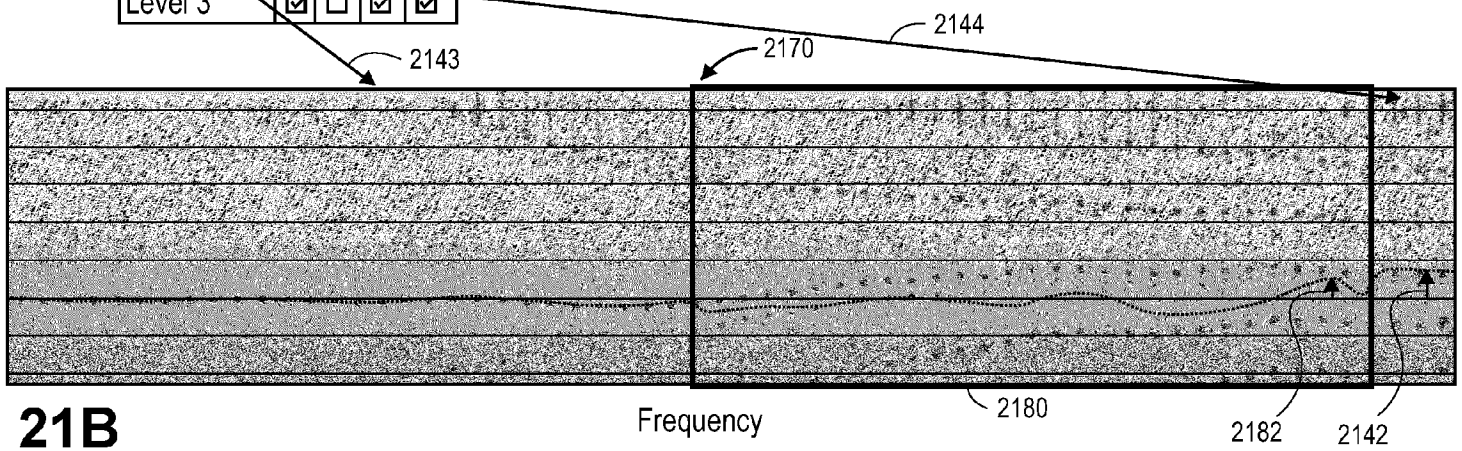
FIG. 21*b* illustrates a frequency response graph with frequency response variation in one embodiment.

FIG. 21*a* illustrates a 2 bit waveform with a compensating pulse in accordance with one embodiment. The 2 bit waveform 2100 includes a compensating pulse 2120, drive pulses 2110 and 2130, and a non-drop-forming portion 2140. This waveform has a frequency response variation as illustrated in FIG. 21*b* in one embodiment. The compensating pulse is associated with a second section, the drive pulse 2010 is associated with a first section, and the drive pulse 2130 is associated with a third section. The frequency response graph 2170 illustrates a 2 pulse drop created by sections 1, 2, and 3 with grayscale (multi-level) printing. The level 2 section mapping is used for lower frequencies and the highest frequencies as indicated with the arrows 2143 and 2144, respectively. The level 3 section mapping is used for intermediate frequencies as indicated with the region 2180. The arrows 2142 and 2182 illustrate a smaller frequency response variation induced by an increase in frequency from left to right of the graph 2170.

The waveforms of the present disclosure can be used for a wide range of operating frequencies to advantageously provide different droplets sizes with improved velocity and mass control. The waveforms also provide improved droplet formation with reduced frequency response variation for improved print head sustainability.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A print head, comprising:

an ink jet module that comprises, a plurality of droplet ejection devices to eject droplets of a fluid; and a control circuitry coupled to the plurality of droplet ejection devices, wherein during operation, the control circuitry is configured to drive the plurality of droplet ejection devices by applying a multi-level waveform comprising a first level and a second level to the plurality of droplet ejection devices and using the multi-level waveform in one of the plurality of droplet ejection devices to eject one or more droplets, wherein the second level includes a first section having at least one compensating edge and a second section having at least one drive pulse and the first level includes the second section without the first section, wherein the at least one compensating edge has a compensating effect to compensate for systematic variation in a droplet parameter across the plurality of the droplet ejection devices, wherein the control circuitry is configured to determine a spatial distribution of a droplet ejection parameter across a plurality of droplet ejection devices, wherein the control circuitry is configured to identify a first group of the plurality of droplet ejection devices and a distribution, wherein the control circuitry is configured to determine a mapping for mapping image pixel levels of the multi-level waveform based on the spatial of the plurality of droplet ejection devices into the second level of the multi-level waveform while the pixels in the first group of the plurality of droplet election devices remain in the first level of the multi-level waveform.

2. The print head of claim 1, wherein the spatial distribution of the droplet ejection parameter comprises a spatial distribution of a droplet velocity across the plurality of the droplet ejection devices.

3. The print head of claim 1, wherein the spatial distribution of the droplet ejection parameter comprises a spatial distribution of a droplet mass across the plurality of the droplet ejection devices.

4. The print head of claim 1, wherein the first section includes a plurality of compensating edges or a plurality of compensating pulses.

5. The print head of claim 1, wherein the at least one compensating edge causes an increase or decrease in drop mass of droplets ejected by the droplet ejection devices.

6. The print head of claim 1, wherein the at least one compensating edge is configured to improve drop formation of droplets ejected by the droplet ejection devices.

7. The print head of claim 1, wherein the at least one compensating edge is configured to reduce frequency response variation of droplets ejected by the droplet ejection devices.

8. The print head of claim 1, wherein the at least one drive pulse in the multilevel waveform comprises a plurality of drive pulses having a separation between adjacent drive pulses that corresponds to a resonance time period of the plurality of droplet ejection devices for ejecting the one or more droplets of a fluid.

9. The print head of claim 1, wherein the at least one compensating edge is designed to not eject a droplet.

10. The print head of claim 1, wherein the at least one compensating edge is designed to compensate for systematic variation of the droplet parameter across different die locations for the plurality of droplet ejection devices.

11. The print head of claim 1, wherein the at least one compensating edge in the first section has a peak voltage that is approximately ten percent of a peak voltage of the at least one drive pulse in the second section of the multi-level waveform.

12. The print head of claim 1, wherein the at least one drive pulse of the multilevel waveform comprises five drive pulses for ejecting the one or more droplets of the fluid.

13. The print head of claim 12, wherein at least one of the five drive pulses has a different peak voltage level than peak voltage levels of the other drive pulses.

14. A print head, comprising:

an ink jet module that comprises, a plurality of droplet ejection devices to eject droplets of a fluid; and control circuitry coupled to the plurality of droplet ejection devices, wherein during operation, the control circuitry to drive the plurality of droplet ejection devices by applying a multi-level waveform to the plurality of droplet ejection devices and using the multi-level waveform in one of the plurality of droplet ejection devices to eject one or more droplets, the multi-level waveform includes a first section having at least one compensating edge and a second section having at least one drive pulse, the at least one compensating edge has a compensating effect to compensate for systematic variation in a droplet parameter across the plurality of the droplet ejection devices, wherein the multi-level waveform further comprises a non-drop-firing portion that includes a jet straightening edge having a droplet straightening function and at least one cancellation edge having an energy canceling function.

15. The print head of claim 14, wherein the at least one compensating edge comprises a compensating pulse with a time period from firing of the compensating pulse and a subsequent firing of a first drive pulse of the plurality of drive pulses is approximately in resonance with the resonance time period.

* * * * *